US007198175B2

(12) United States Patent
Ophardt

(10) Patent No.: US 7,198,175 B2
(45) Date of Patent: Apr. 3, 2007

(54) MANUAL OR PUMP ASSIST FLUID DISPENSER

(76) Inventor: Heiner Ophardt, 3931 Vineland Crescent, Vineland, Ontario (CA) L0R 2C0

( * ) Notice: Subject to any disclaimer, the term of this patent is extended or adjusted under 35 U.S.C. 154(b) by 386 days.

(21) Appl. No.: 10/810,615

(22) Filed: Mar. 29, 2004

(65) Prior Publication Data

US 2004/0217137 A1 Nov. 4, 2004

Related U.S. Application Data

(63) Continuation-in-part of application No. 10/132,321, filed on Apr. 26, 2002, now Pat. No. 6,957,751.

(30) Foreign Application Priority Data

Jun. 19, 2003 (CA) ..... 2432814

(51) Int. Cl.
*B67D 1/08* (2006.01)

(52) U.S. Cl. ..... 222/188; 222/457; 222/587; 222/333; 222/481.5

(58) Field of Classification Search ..... 222/481.5, 222/181.1, 181.3, 183, 182, 333, 383.2, 410, 222/457, 587; 415/206; 417/424.2
See application file for complete search history.

(56) References Cited

U.S. PATENT DOCUMENTS 2,680,010 A * 6/1954 Dubay ..... 261/124
4,324,349 A 4/1982 Kaufman
4,930,668 A 6/1990 Krall
4,957,218 A * 9/1990 Ford, Jr. ..... 222/1
5,060,830 A * 10/1991 Krall ..... 222/212
5,165,577 A 11/1992 Ophardt
5,282,552 A 2/1994 Ophardt
5,329,117 A 7/1994 Galili
D350,665 S 9/1994 Ophardt
5,373,970 A 12/1994 Ophardt
5,427,279 A 6/1995 Kaufman
5,431,309 A 7/1995 Ophardt
5,489,044 A 2/1996 Ophardt
D378,035 S 2/1997 Ophardt
5,676,277 A 10/1997 Ophardt
5,836,482 A 11/1998 Ophardt
5,904,272 A * 5/1999 Kaufman et al. ..... 222/207
5,960,991 A 10/1999 Ophardt
5,975,360 A 11/1999 Ophardt (Continued)

FOREIGN PATENT DOCUMENTS

EP 0 381 884 A 8/1990

(Continued)

*Primary Examiner*—Kevin Shaver
*Assistant Examiner*—Stephanie E. Tyler
(74) *Attorney, Agent, or Firm*—Riches, McKenzie & Herbert LLP

(57) ABSTRACT

Liquid soap dispensers including a vacuum relief valve which comprises an enclosed chamber having an air inlet open to the atmosphere and a liquid inlet in communication with liquid in the reservoir and in which the liquid inlet opens to the chamber at a height below a height at which the air inlet opens to the chamber. The vacuum relief valve permits relief of vacuum from the reservoir without moving parts or valves. A chamber about an opening of an inverted container with an impeller within the chamber which, on rotation, dispenses fluid from the chamber.

22 Claims, 33 Drawing Sheets

U.S. PATENT DOCUMENTS

| | | | |
|---|---|---|---|
| 6,206,238 | B1 | 3/2001 | Ophardt |
| 6,343,724 | B1 | 2/2002 | Ophardt |
| 6,390,329 | B1 | 5/2002 | Maddox |
| 6,467,651 | B1 | 10/2002 | Muderlak |
| 2005/0054086 | A1 | 3/2005 | Ophardt |

FOREIGN PATENT DOCUMENTS

| | | |
|---|---|---|
| FR | 1 039 725 A | 10/1953 |
| GB | 1386152 | 3/1972 |
| WO | WO 81/01993 | 7/1981 |

* cited by examiner

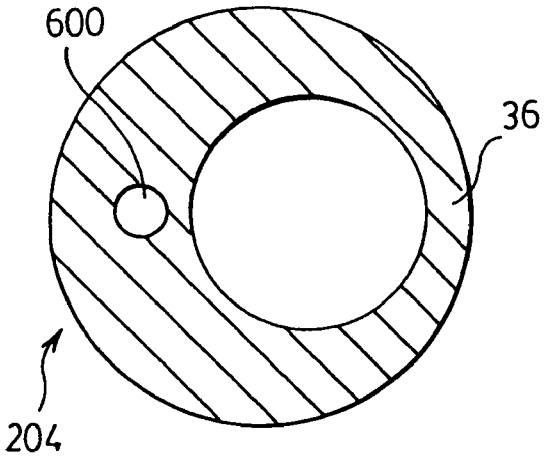
FIG. 35
FIG. 36
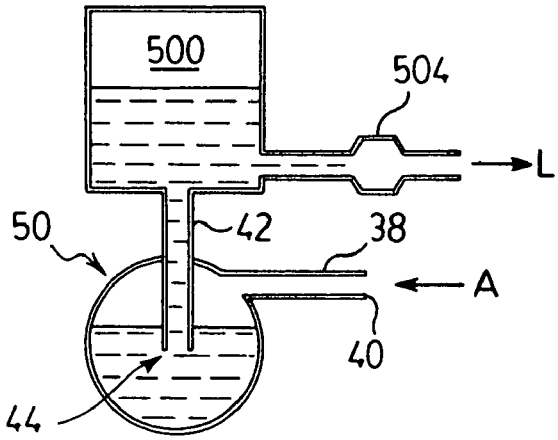
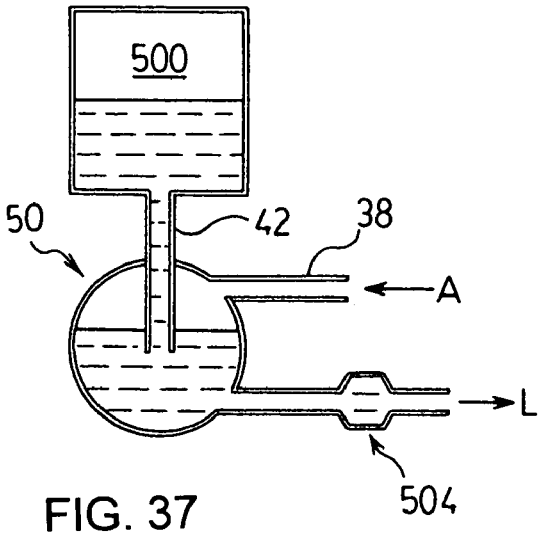
FIG. 37
FIG. 38
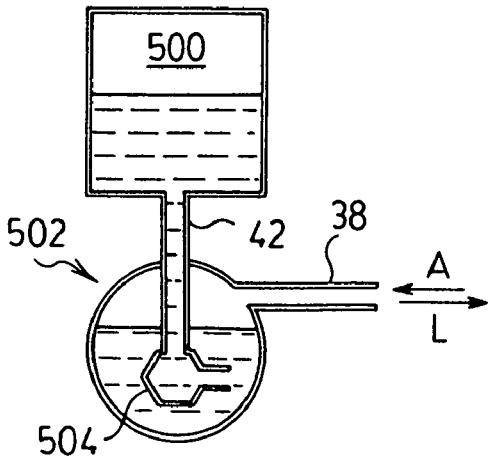

MANUAL OR PUMP ASSIST FLUID DISPENSER

RELATED APPLICATION

This application is a continuation-in-part of U.S. patent application Ser. No. 10/132,321 filed Apr. 26, 2002 now U.S. Pat. No. 6,957,751.

SCOPE OF THE INVENTION

This invention relates to a fluid dispenser and, more particularly, to a fluid dispenser for automated and/or manual pumping operation.

BACKGROUND OF THE INVENTION

Arrangements are well known by which fluid is dispensed from fluid containing reservoirs. For example, known hand soap dispensing systems provide reservoirs containing liquid soap from which soap is to be dispensed. When the reservoir is enclosed and rigid so as to not be collapsible then, on dispensing liquid soap from the reservoir, a vacuum comes to be created in the reservoir. It is known to provide one-way valves which permit atmospheric air to enter the reservoir and permit the vacuum in the reservoir to be reduced. The one-way valves typically operate such that the one-way valve prevents air from entering the reservoir unless a vacuum is developed to a certain level below atmospheric pressure. To the extent that the vacuum increases beyond this certain level, then the valve will open permitting air to enter the reservoir and thereby prevent the vacuum from increasing further.

The provision of vacuum relief valves is advantageous not only in enclosed reservoirs which are rigid but also with reservoirs that may not so readily collapse as to prevent the development of a vacuum within the reservoir on dispensing.

The present inventor has appreciated that reducing the ability of vacuum conditions to arise in any reservoir can be advantageous so as to facilitate dispensing of fluid from the reservoir, particularly so as to permit dispensing with a minimal of effort and with a pump which has minimal ability to overcome any vacuum pressure differential to atmospheric pressure.

U.S. Pat. No. 5,676,277 to Ophardt which issued Oct. 14, 1997 discloses in FIG. 10 a known one-way valve structure in which a resilient flexible seal member is biased to close an air passageway such that on the development of vacuum within a reservoir, the seal member is deflected out of a position to close the air passageway and permits atmospheric air to enter the reservoir relieving the vacuum. Such flexible seal members suffer the disadvantage that they are subject to failure, do not always provide a suitable seal, and to be flexible must frequently be made from different materials than the remainder of the value structure. As well as insofar as a flexible seal member is to be maintained in contact with fluid from the reservoir, then difficulties may arise in respect of degradation of the flexible sealing member with time. As well, the flexible sealing member typically must experience some minimal level of vacuum in order to operate and such minimal level of vacuum can, in itself, at times present difficulty in dispensing fluid from the reservoir.

Most known soap dispensers suffer the disadvantage that they do not provide for inexpensive simple and/or energy efficient systems to dispense fluid, particularly when the systems are for automatically dispensing fluids with motor driven pumps. As a further disadvantage, known systems which use motor driven pumps do not permit for manual dispensing of the liquid as an alternative to dispensing with the motor driven pump as, for example, in the situation where the pump is inoperative. The pump may be inoperative as, for example, by reason of malfunction of the pump mechanism or the loss of power as, for example, under power failure conditions or if batteries to drive the pump have become depleted.

SUMMARY OF THE INVENTION

To at least partially overcome these disadvantages of previously known devices, the present invention provides a vacuum relief valve which comprises an enclosed chamber having an air inlet open to the atmosphere and a liquid inlet in communication with liquid in the reservoir and in which the liquid inlet opens to the chamber at a height below a height at which the air inlet opens to the chamber.

The present invention also provides in one aspect a chamber about an opening of an inverted container with an impeller within the chamber which, on rotation, dispenses fluid from the chamber. More preferably, the chamber is a vacuum relief chamber.

An object of the present invention is to provide a simplified vacuum relief device, preferably for use with an enclosed reservoir in a fluid dispensing application.

Another object is to provide a vacuum relief device without moving parts.

Another object is to provide a vacuum relief device as part of a disposable plastic liquid pump.

Another object is to provide a liquid dispenser which is substantially drip proof.

Another object is to provide a simple dispenser in which a vacuum relief device for relieving vacuum in a reservoir also permits dispensing of liquid therethrough when the reservoir is pressurized.

Another object of the present invention is to provide a simplified fluid dispenser which provides for a motor driven pump to dispense fluid.

Another object of the present invention is to provide a fluid dispenser with a motor driven pump to dispense fluid which system is particularly adapted for use with batteries and is of low cost.

Another object is to provide a fluid dispenser which permits dispensing by driving a pump through use of a motor or manual activation.

Another object is to provide a liquid dispenser which is resistant to dripping liquid therefrom when not in use.

Accordingly, in one aspect, the present invention provides a vacuum relief device adapted to permit atmospheric air to enter a liquid containing reservoir to reduce vacuum developed in the reservoir, the device comprising:

an enclosed chamber having an air inlet and a liquid inlet, the air inlet in communication with air at atmospheric pressure, the liquid inlet in communication with liquid in the reservoir, the liquid inlet open to the chamber at a height which is below a height at which the air inlet is open to the chamber.

In another aspect, the present invention provides, in combination, an enclosed, liquid containing reservoir and a vacuum relief device, the reservoir having a reservoir outlet from which liquid is to be dispensed and within which reservoir a vacuum below atmospheric pressure is developed on dispensing liquid from the reservoir outlet, the vacuum relief device is adapted to permit atmospheric air to enter the reservoir to reduce any vacuum developed in the reservoir, the vacuum relief device comprising an enclosed chamber having an air inlet and a liquid inlet, the liquid inlet open to the chamber at a height, which is below a height at which the air inlet is open to the chamber, the air inlet in communication with air at atmospheric pressure such that the chamber is at atmospheric pressure, the liquid inlet connected by via a liquid passageway with liquid in the reservoir, the liquid inlet at a height below a height of liquid in the reservoir such that when pressure in the reservoir is atmospheric pressure, due to gravity the liquid from the reservoir fills the liquid passageway and, via the liquid passageway, fills the chamber to a height above the height of the liquid inlet and below the height of the air inlet, and wherein on dispensing liquid from the reservoir outlet increasing vacuum below atmospheric in the reservoir, the height of liquid in the chamber decreases until the height of liquid is below the height of the liquid inlet and the liquid inlet is open to air in the chamber such that air in the chamber flows under gravity upward through the liquid passageway to the reservoir to decrease vacuum in the reservoir.

In another aspect, the present invention provides, in combination, an enclosed, liquid containing reservoir and a vacuum relief device and a pump, the reservoir having a reservoir outlet and within which reservoir a vacuum below atmospheric pressure is developed on drawing liquid from the reservoir via the outlet, and the vacuum relief device is adapted to permit atmospheric air to enter the reservoir to reduce any vacuum developed in the reservoir, the vacuum relief device comprising an enclosed chamber having an air inlet and a liquid inlet, the liquid inlet open to the chamber at a height, which is below a height at which the air inlet is open to the chamber, the air inlet in communication with air at atmospheric pressure such that the chamber is at atmospheric pressure, the liquid inlet connected by via a liquid passageway with the reservoir outlet, the liquid inlet at a height below a height of liquid in the reservoir such that when there is atmospheric pressure in the reservoir under gravity, the liquid from the reservoir fills the liquid passageway and, via the liquid passageway, fills the chamber to a height above the height of the liquid inlet and below the height of the air inlet, and wherein with increased vacuum below atmospheric in the reservoir the height of liquid in the chamber decreases until the height of liquid is below the height of the liquid inlet and the liquid inlet is open to air in the chamber such that air in the chamber flows under gravity upward through the liquid passageway to the reservoir to decrease vacuum in the reservoir, a liquid outlet from the chamber open to the chamber at a height below the height of the liquid inlet, a feed passageway connecting the liquid outlet with the pump, the pump being operable to draw liquid from the chamber via the liquid outlet and dispense it via a dispensing passageway to a dispensing outlet open to atmospheric pressure, the dispensing passageway in extending from the pump to the dispensing outlet rising to a height above the height of the liquid inlet such that liquid in the dispensing passageway will, when the pump is not operating, assume a height in the dispensing passageway which is the same as the height in the chamber and below the height of the dispensing outlet to prevent flow of liquid due to gravity from the chamber out of the dispensing outlet.

In another aspect, the present invention provides a liquid dispenser comprising:

a resilient, enclosed container enclosed but for having at one end of the container a neck open at a container outlet opening, a cap having an end wall and a side wall extending from the end wall to an remote portion of the side wall, a cap outlet opening through the side wall, the cap received on the neck with the neck extending into the cap, the remote portion of the cap about the neck engaging the neck to form fluid impermeable seal therewith, a passageway defined between the neck and the side wall of the cap outwardly of the neck and inwardly of the side wall open to both the container outlet opening and the cap outlet opening, wherein when the container is in an inverted position with the neck located below the remainder of the container, the container outlet opening is at a height which is below a height of the cap outlet opening.

A vacuum relief valve in accordance with the present invention is adapted for use in a number of different embodiments of fluid reservoirs and dispensers. It can be formed to be compact so as to be a removable plastic compartment as, for example, adapted to fit inside the neck of a bottle as, for example, part of and inwardly from a pump assembly forming a plug for a bottle.

The vacuum relief valve may be used not only to relieve vacuum pressure in a reservoir but also for dispensing liquid therethrough, either due to pressure in the reservoir or a pump drawing liquid out from a chamber in the vacuum relief valve.

The vacuum relief valve may be used to provide a dispenser which does not drip by having dispensed from a chamber in the vacuum relief valve through a dispensing tube which rises to a height above the liquid level in the chamber in the vacuum relief valve.

The vacuum relief valve may be configured to be closed to prevent liquid flow from a reservoir and to be opened for operation.

Accordingly, in another aspect, the present invention provides a liquid dispenser comprising:

a resilient, enclosed container enclosed but for having at one end of the container a neck open at a container outlet opening, a cap having an end wall and a side wall of extending upwardly from the end wall to an remote portion of the side wall, a cap outlet opening through the side wall, the cap received on the neck with the neck extending into the cap, the remote portion of the cap about the neck engaging the neck to form fluid impermeable seal therewith, a passageway defined between the neck and the side wall of the cap outwardly of the neck and inwardly of the side wall open to both the container outlet opening and the cap outlet opening, wherein when the container is in an inverted position with the neck located below the remainder of the container, the container outlet opening is at a height which is below a height of the cap outlet opening, the side wall of the cap being disposed about an axis, the container outlet opening disposed coaxially within the side wall of the cap, an impeller disposed in the cap above the end wall of the cap and at least partially below the container outlet opening journalled for rotation about the axis, the impeller adapted on rotation to receive fluid above the impeller from the container outlet opening and to direct liquid radially outwardly into the passageway such that rotation of the impeller forces fluid into the passageway raising the level of fluid in the passageway to a height above the height of the cap outlet opening such that fluid flows out of the cap outlet opening.

the impeller when not rotating not preventing air flow from the cap outlet opening to the container outlet opening.

In another aspect, the present invention provides a liquid dispenser comprising:

an enclosed resilient container enclosed but for having at one lower end of the container a neck open at a container outlet opening, the container outlet opening in sealed communication with a chamber forming element defining a chamber, the chamber having an air inlet and a liquid inlet, the liquid inlet open to the chamber at a height which is below a height at which the air inlet is open to the chamber, the air inlet in communication with air at atmospheric pressure such that the chamber is at atmospheric pressure, the liquid inlet connected via a liquid passageway with liquid in the container, the liquid inlet at a height below a height of liquid in the container such that when pressure in the container is atmospheric pressure, due to gravity, the liquid from the container fills the liquid passageway and, via the liquid passageway, fills the chamber to a height above the height of the liquid inlet and below the height of the air inlet, and wherein on dispensing liquid from the container increases vacuum below atmospheric in the container, the height of liquid in the chamber decreases until the height of liquid is below the height of the liquid inlet and the liquid inlet is open to air in the chamber such that air in the chamber flows under gravity upward through the liquid passageway to the container to decrease vacuum in the reservoir, an impeller rotatably received in the chamber for rotation to draw liquid via the rigid passageway from the container and raise the height of liquid in the chamber above the height of the air inlet.

BRIEF DESCRIPTION OF THE DRAWINGS

Further aspects and advantages of the invention will become apparent from the following description taken together with the accompanying drawings in which:

FIG. 35 is a cross-sectional view along section line 14–14' in FIG. 13; and Each of FIGS. 36 to 42 illustrate arrangements of a fluid reservoir, a pressure relief mechanism and a pump for use as a fluid dispenser;

DETAILED DESCRIPTION OF THE DRAWINGS

Figure 1:
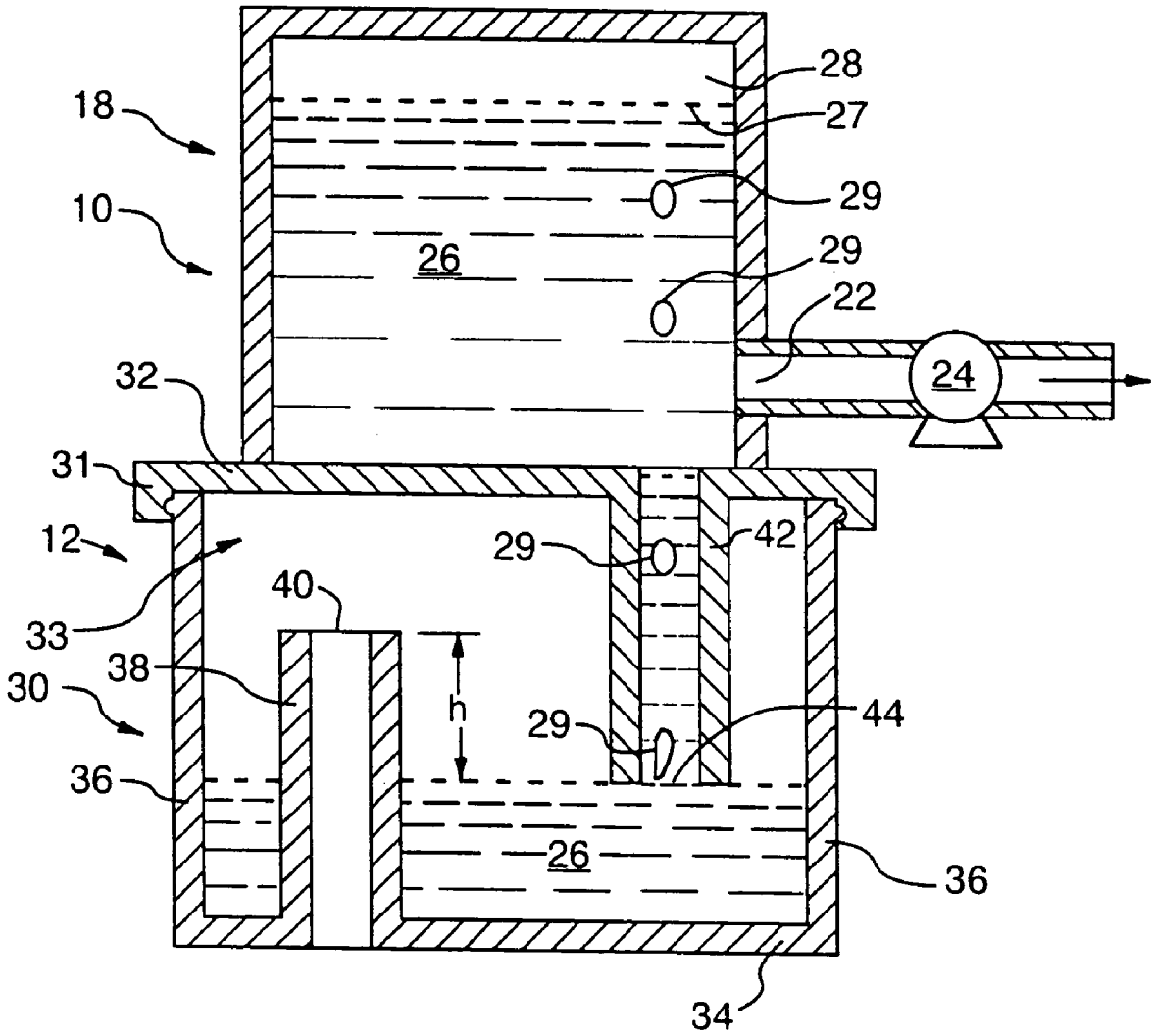
FIG. 1 is a schematic view of the soap dispenser incorporating a vacuum relief device in accordance with a first embodiment of the present invention illustrating a condition in which atmospheric air is passing into a reservoir.
Figure 2:
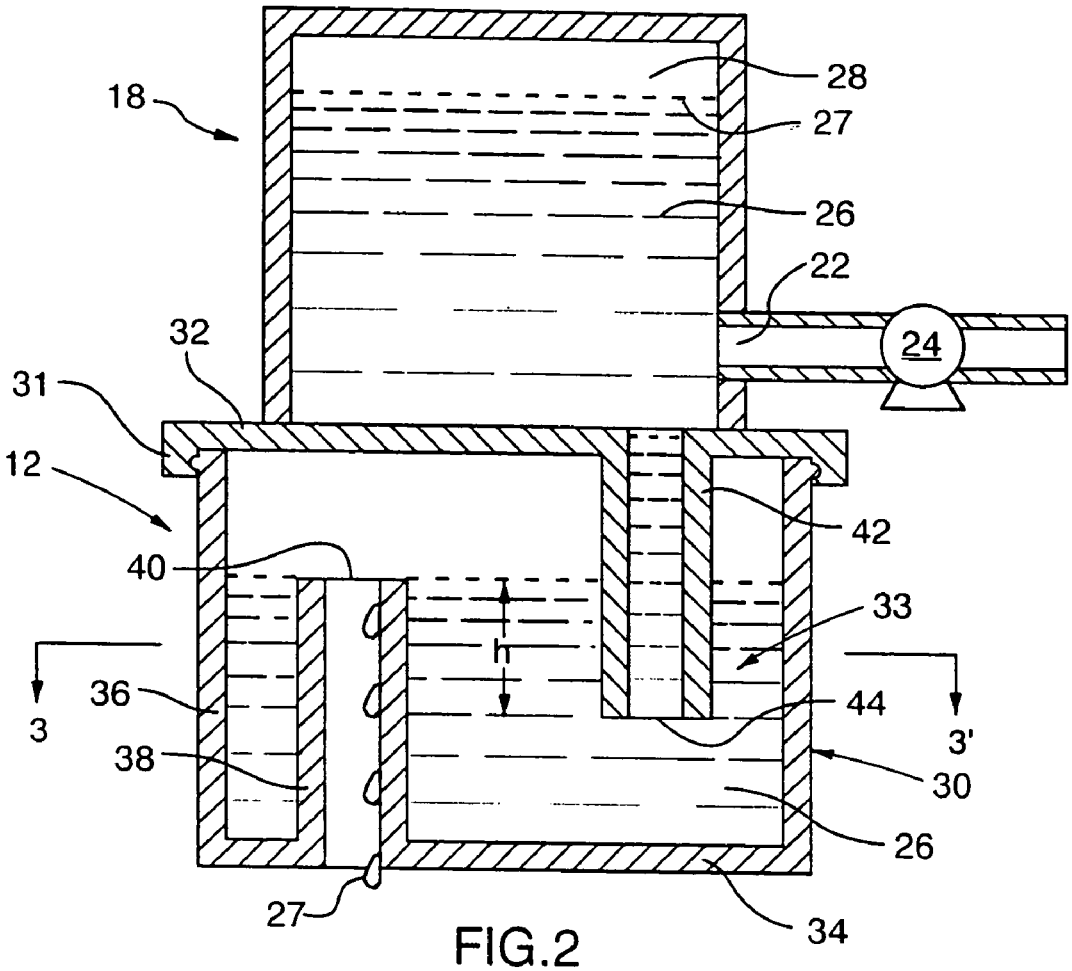
FIG. 2 is a schematic side view of the soap dispenser of FIG. 1, however, illustrating a condition in which liquid is at a position to flow from the vacuum relief device.
Figure 3:
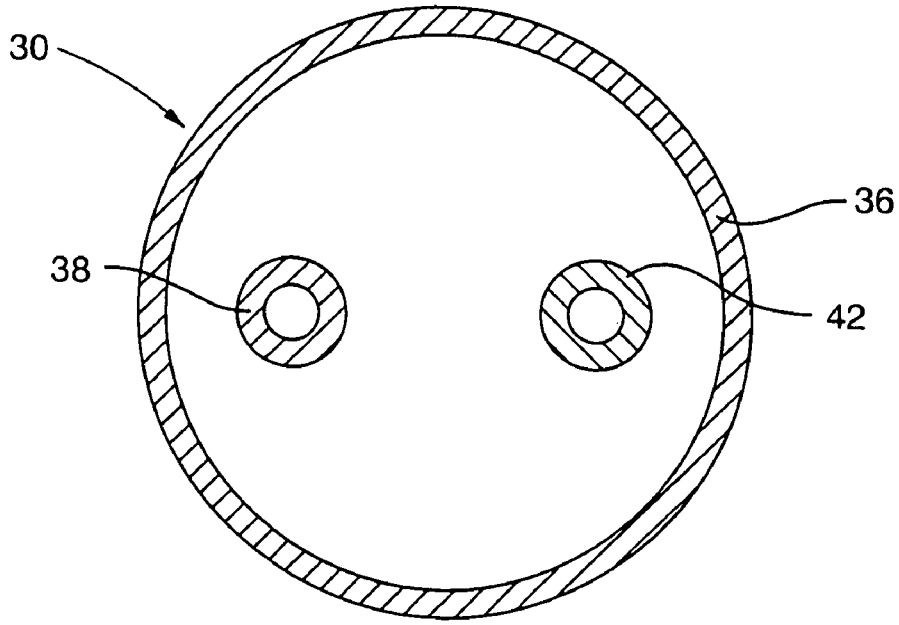
FIG. 3 is a cross-sectional view through the vacuum relief device of FIG. 1 along section lines 3–3'.

Reference is made first to FIGS. 1, 2 and 3 which schematically show, without regard to scale, a soap dispensing apparatus 10 incorporating a vacuum relief device 12 in accordance with the present invention. A reservoir 18 is shown schematically as comprising an enclosed non-collapsible reservoir having an outlet 22 in communication with a pump 24. The pump 24 is operative to dispense fluid 26 from the reservoir. The reservoir is shown to have fluid 26 in the lower portion of the reservoir with an upper surface 27 separating the fluid 26 from a pocket of air 28 within an upper portion of reservoir above the fluid 26.

The vacuum relief device 12 is illustrated as having a vessel including a base 30 and a cap 32 forming an enclosed chamber 33. As best seen in FIG. 3, the base 30 is cylindrical having a bottom wall 34 and a cylindrical upstanding side wall 36. The cap 32 is shown as having a cylindrical lip portion 31 adapted to secure the cap 32 to the upper edge of the cylindrical side wall 36 of the base forming a fluid tight seal therewith. A cylindrical air tube 38 extends upwardly from the base 30 to an air inlet 40. A liquid tube 42 extends downwardly from the cap 32 to a liquid inlet 44. As seen in both FIGS. 1 and 2, the vacuum relief device 12 is intended to be used in a vertical orientation as shown in the figures with the cap 32 at an upper position and the cylindrical side wall 36 oriented to extend vertically upwardly. As shown, the air inlet 40 opens into the chamber 33 at a height which is above a height at which the liquid inlet 44 opens into the chamber 33. The vertical distance between the air inlet 40 and the liquid inlet 44 is illustrated as being "h".

The vacuum relief device 12 is to be coupled to the reservoir 18 in a manner that the liquid inlet 44 is in communication via a liquid passageway passing through liquid tube 42 with the fluid 26 in the reservoir. For simplicity of illustration, the reservoir 18 is shown to have an open bottom which is in a sealed relation with the cap 32. The air inlet 40 is in communication via the air tube 38 with atmospheric air at atmospheric pressure.

Referring to FIG. 1, in the condition shown, the pump 24 has dispensed liquid from the reservoir such that the pressure in the reservoir 18 has been drawn below atmospheric pressure thus creating a vacuum in the reservoir. As a result of this vacuum, liquid 26 within the chamber 33 has been drawn upwardly from the chamber 33 through the liquid tube 42 into the reservoir 18. FIG. 1 illustrates a condition in which the vacuum which exists in the reservoir 18 is sufficient that the level of the liquid 26 in the chamber 33 has been drawn down to the height of the liquid inlet 44 and thus air which is within the chamber 33 above the liquid 26 in the chamber 33 comes to be at and below the height of the liquid inlet 44 and, thus, has entered the liquid tube 42 via the liquid inlet 44 and the air is moving as shown by air bubbles 29 under gravity upwardly through the fluid 26 in liquid tube 44 and reservoir 18 to come to form part of the air 28 in the top of the reservoir 18.

Since the air tube 38 is open to atmospheric air, atmospheric air is free to enter the chamber 33 via the air tube 38 and, hence, be available to enter the liquid tube 42.

Reference is made to FIG. 2 which is identical to FIG. 1, however, shows a condition in which the level of liquid 26 in the chamber 33 is just marginally above the height of the air inlet 40 and liquid 26 is flowing from the chamber 33 out the air tube 38 as shown by liquid droplets 27.

FIG. 2 illustrates a condition which is typically not desired to be achieved under normal operation of the fluid dispensing system of FIGS. 1 to 3. That is, the vacuum relief device 12 is preferably to be used as in the embodiment of FIGS. 1 to 3 in a manner to permit air to pass into the reservoir 18 as illustrated in FIG. 3 and it is desired to avoid a condition as shown in FIG. 2 in which fluid 26 will flow out of the air tube 38.

In the first embodiment of FIGS. 1 to 3, the air inlet 40 is desired to be at a height above the height to which the level of the liquid may, in normal operation, rise in the chamber 33. It is, therefore, a simple matter to determine this height and provide a height to the air inlet 40 which ensures that under reasonable operating conditions that the liquid will not be able to flow from the chamber 33 out the air tube 38.

Provided the fluid 26 fills the chamber 33 to or above the level of the liquid inlet 44, then air from the chamber 33 is prevented from accessing the liquid inlet 44 and cannot pass through the liquid tube 42 into the reservoir. The ability of liquid 26 to be dispensed out of the reservoir 18 by the pump 26 may possibly be limited to some extent to the degree to which a vacuum may exist in the reservoir. For vacuum to exist in the reservoir, there must be an expandable fluid in the reservoir such as air 28 or other gases above the liquid 26. At any time, the level of the liquid in the chamber 33 will be factor which will determine the amount of additional vacuum which must be created within the reservoir 18 in order for the level of liquid in the chamber 33 to drop sufficiently that the level of liquid in the chamber 33 becomes below the liquid inlet 44 and air may pass from the chamber 33 up through the liquid tube 42 into the reservoir 18 to reduce the vacuum.

As seen in FIGS. 1 and 2, the liquid 26 forms a continuous column of liquid through the liquid in the chamber 33, through the liquid in the liquid tube 42 and through the liquid in the reservoir 18. Air which may enter liquid inlet 44 will flow upwardly to the top of the reservoir 18 without becoming trapped as in a trap like portion of the liquid passageway. Similarly, liquid 26 will flow downwardly from the reservoir 18 through the liquid tube 42 to the chamber 33 to effectively self-prime the system, unless the vacuum in the reservoir 18 is too great.

Figure 4:
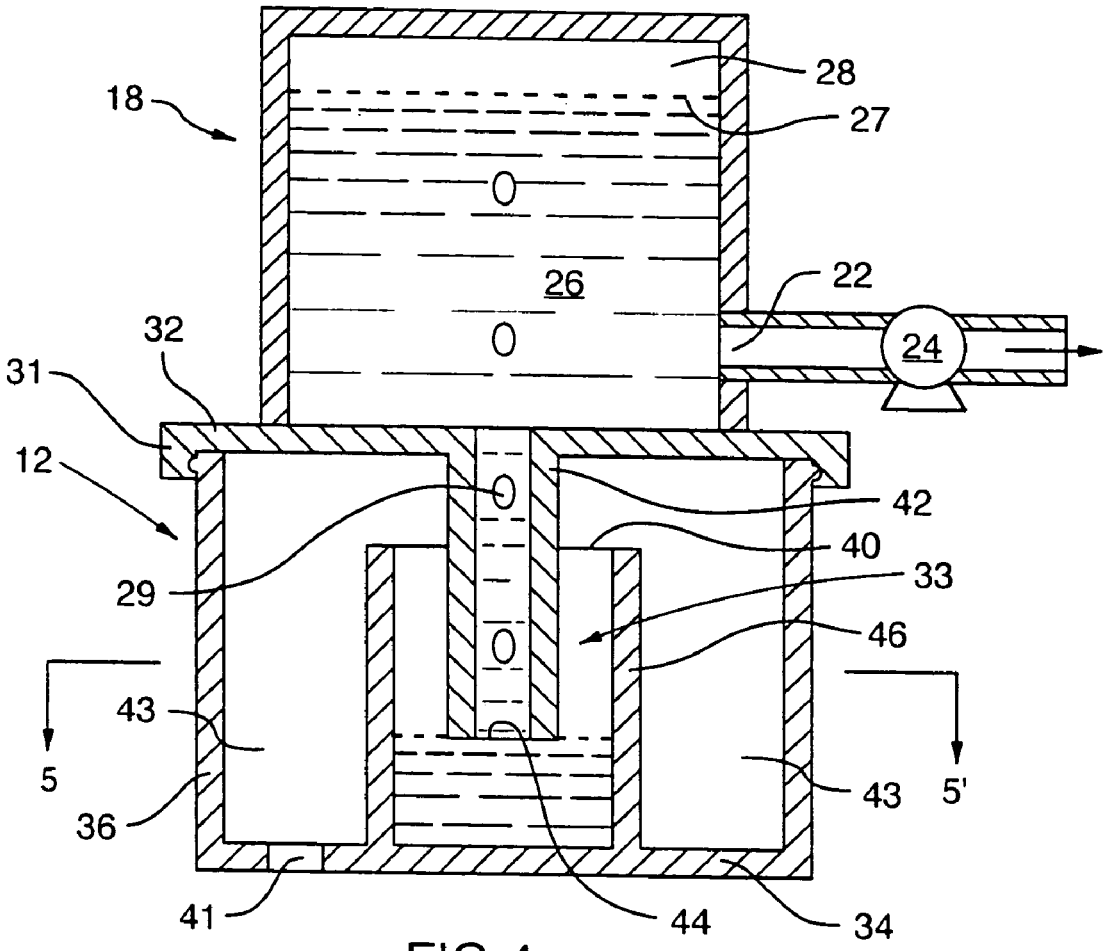
FIG. 4 is a schematic cross-sectional view of a fluid dispenser including a vacuum relief device in accordance with a second embodiment of the invention under conditions in which atmospheric air is passing into a reservoir.
Figure 5:
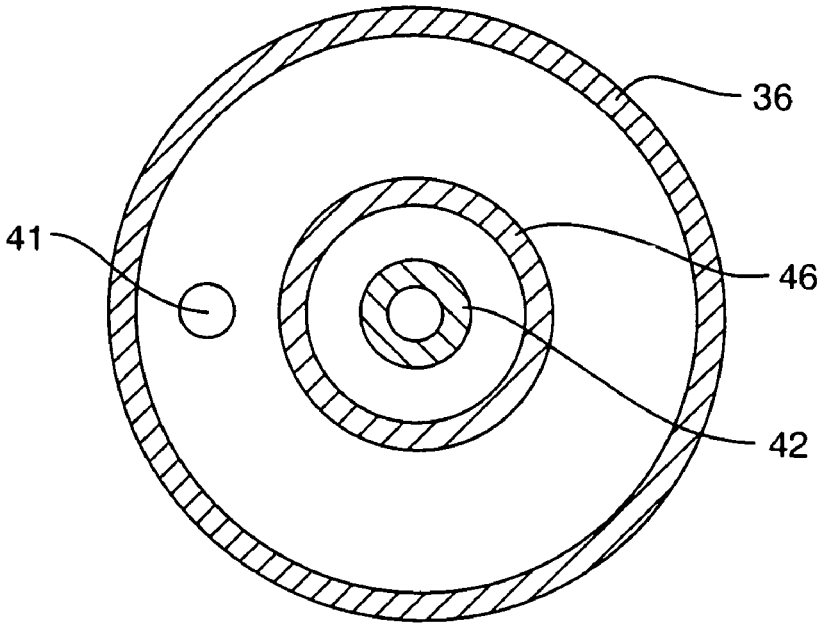
FIG. 5 is a cross-sectional view through the vacuum relief device of FIG. 4 along section lines 5–5'.

Reference is made to FIGS. 4 and 5 which show a second embodiment of a vacuum relief device 10 in accordance with the present invention illustrated in a similar schematic arrangement as the first embodiment of FIGS. 1 to 3. The second embodiment has an equivalent to every element in the first embodiment, however, is arranged such that the liquid tube 42 is coaxial with the cap 32 and a cylindrical holding tube 46 extends upwardly from the base 30 concentrically about the liquid tube 42. An air aperture 41 is provided in the base 30 opening into an annular air passageway 43 between the cylindrical side wall 36 and the holding tube 46. Conceptually, as compared to FIG. 1, the effective location and height of the air inlet 40 is at the upper open end of the holding tube 46 which is, of course, at a height above the liquid inlet 44. FIG. 4 shows a condition in which the vacuum in the reservoir 18 is sufficient that the liquid in the holding tube 46 is drawn downwardly to the level of the liquid inlet 44 and air, as in air bubbles 29, may flow upwardly through the liquid tube 42 into the reservoir 18 to relieve the vacuum.

In both the embodiments illustrated in FIGS. 1 to 3 and in FIGS. 4 and 5, the vacuum relief device is constructed of two parts, preferably of plastic by injection moulding with a cap 32 adapted to be secured in a sealing relation to be the base 30. The vacuum relief device 12 is adapted to be received within an opening into the reservoir 18 or otherwise provided to have, on one hand, communication with liquid in the reservoir and, on the other hand, communication with atmospheric air.

Figure 6:
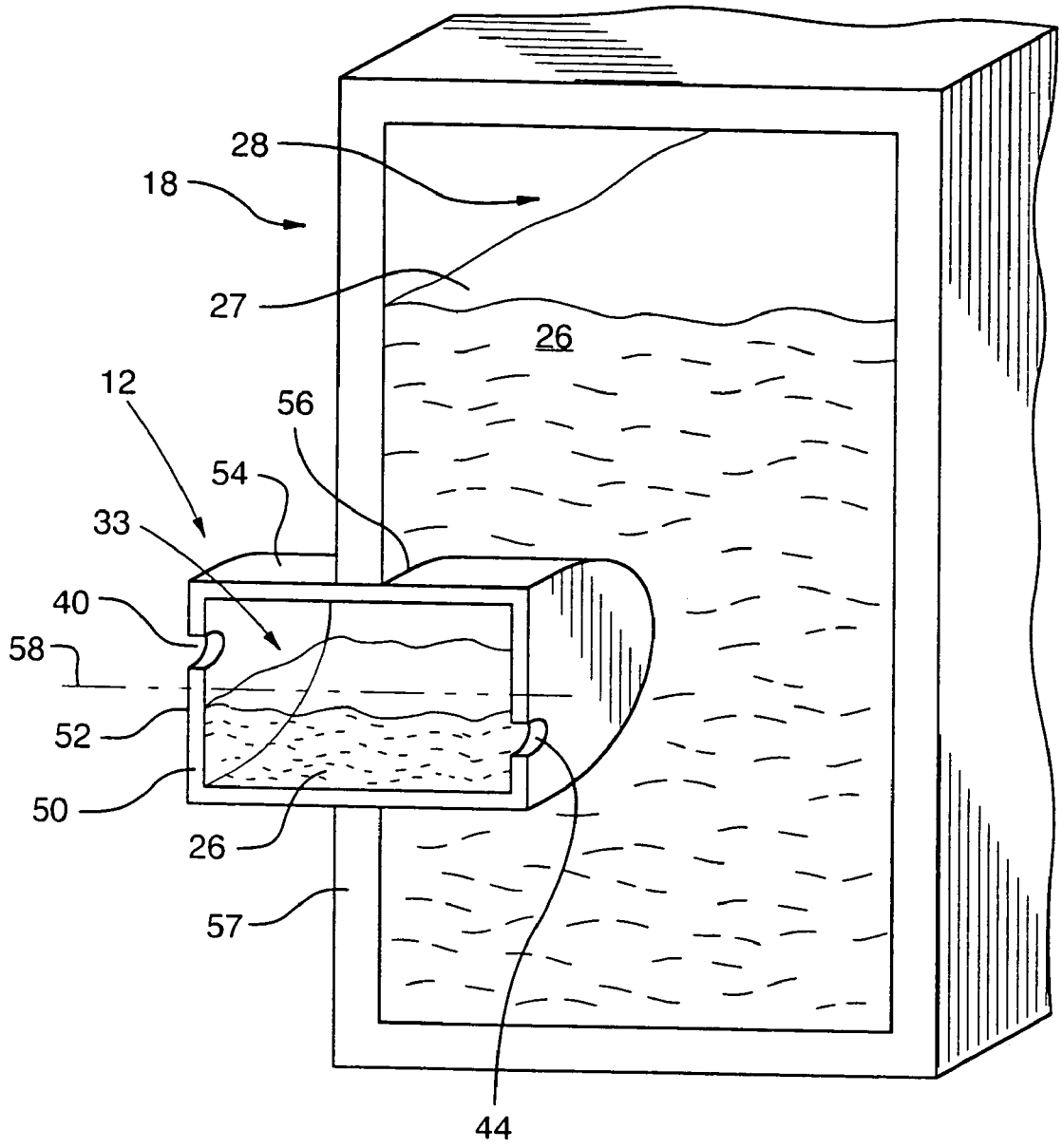
FIG. 6 is a schematic pictorial and partially sectional view of a third embodiment of a vacuum relief value in accordance with present invention.

FIG. 6 illustrates another simple embodiment of a vacuum relief device 12 in accordance with the present invention. In this embodiment, the device 12 comprises a cylindrical vessel with closed flat end walls 50 and 52 and a cylindrical side wall 54 which is adapted to be received in a cylindrical opening 56 in the side wall 57 of a reservoir 18 as shown, preferably with a central axis 58 through the cylindrical vessel disposed generally horizontally. An inner end wall 50 of the vessel has the liquid inlet 44 and the outer end wall 52 of the vessel has the air inlet 40. The vessel is to be secured to the reservoir 18 such that the air inlet 40 is disposed at a height above the liquid inlet 44. It is to be appreciated that this height relationship may be accommodated by orienting the device 10 at orientations other than with the axis 58 horizontal as shown. FIG. 6 illustrates a cross-sectional through a vertical plane including the central axis 58 and in which plane for convenience the centers of each of the air inlet 40 and liquid inlet 44 lie.

Figure 7:
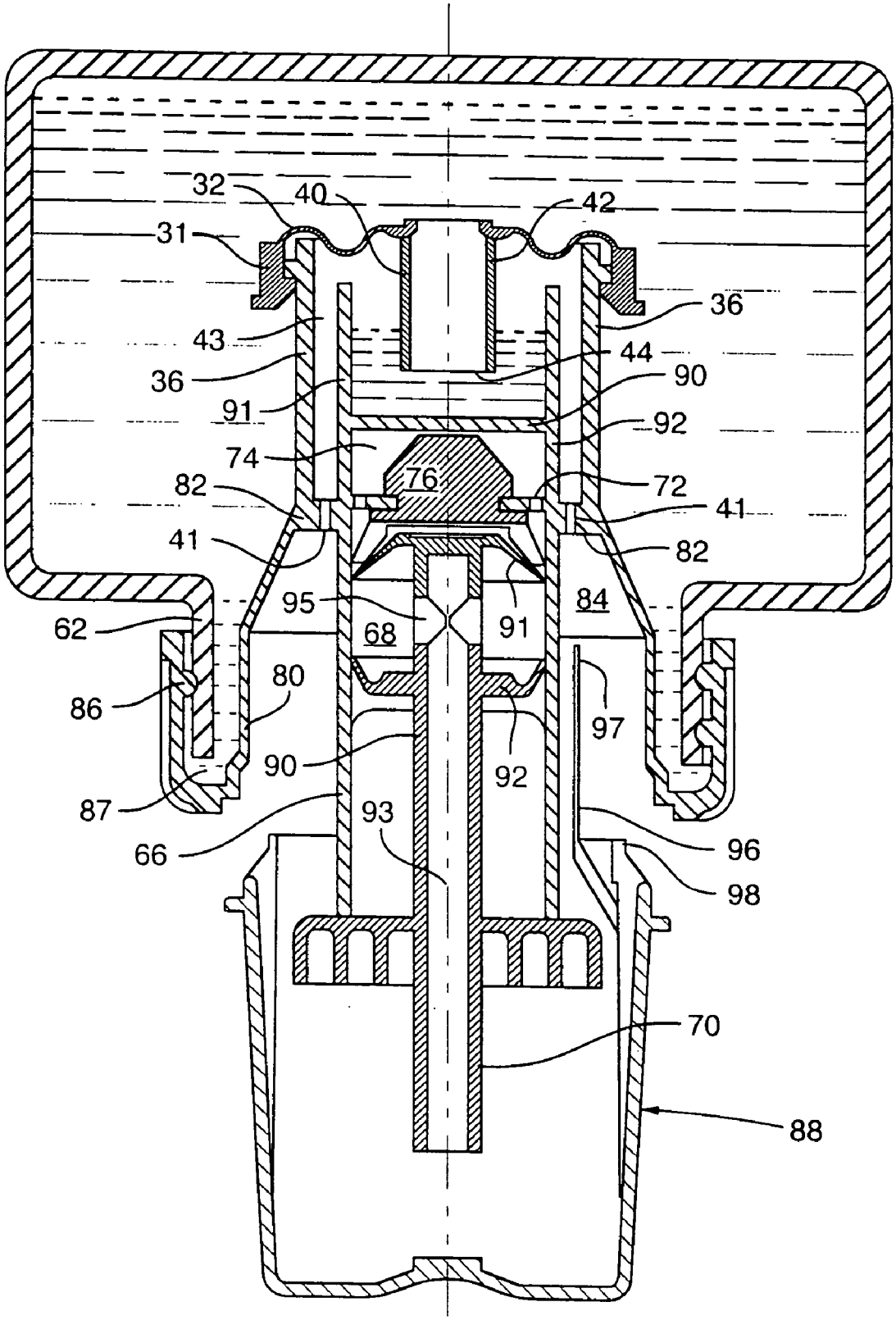
FIG. 7 is a cross-sectional side view of a liquid dispenser having a pump assembly attached to a reservoir and incorporating a vacuum relief device in accordance with a fourth embodiment of the present invention.
Figure 8:
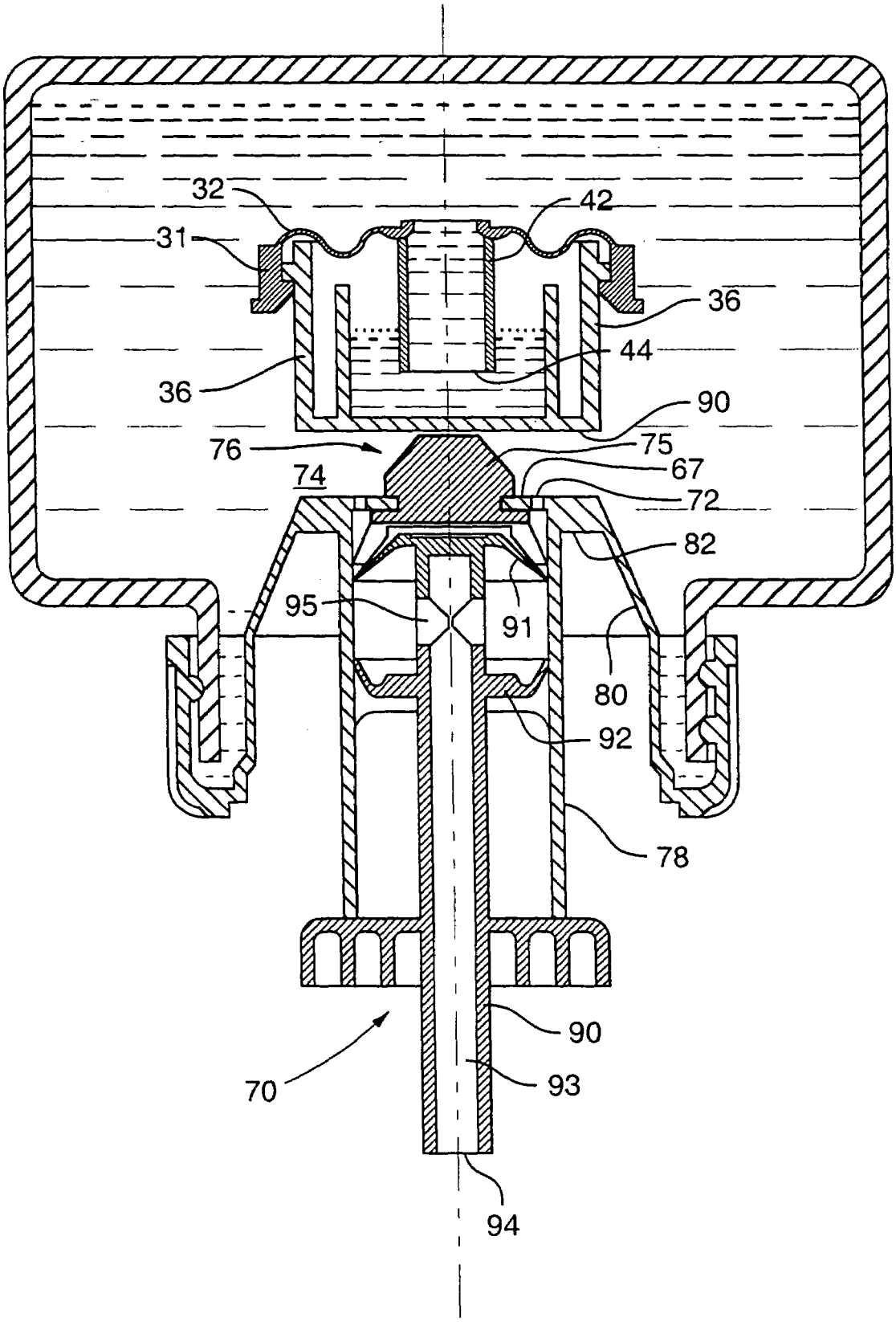
FIG. 8 is a cross-sectional side view through FIG. 7 normal to the cross-section through FIG. 7.

Reference is made to FIGS. 7 and 8 which show a liquid dispenser having a pump assembly attached to a reservoir and incorporating the vacuum relief device in accordance with the present invention. The pump assembly of FIGS. 7 and 8 has a configuration substantially as disclosed in FIG. 10 of the applicant's U.S. Pat. No. 5,676,277 to Ophardt, issued Oct. 14, 1997 (which is incorporated herein by reference) but including a vacuum relief valve device 12 in accordance with the present invention mounted coaxially with the pump assembly inwardly of the pump assembly.

The reservoir 18 is a rigid bottle with a threaded neck 62. The pump assembly has a piston chamber-forming body 66 defining a chamber 68 therein in which a piston forming element or piston 70 is slidably disposed for reciprocal movement to dispense fluid from the reservoir. Openings 72 in the end wall 67 of the chamber 68 is in communication with the fluid in the reservoir 18 via a radially extending passageway 74 as best seen in FIG. 8. A one-way valve 76 across the opening 72 permits fluid flow outwardly from the passageway 74 into the chamber 68 but prevents fluid flow inwardly.

The piston chamber-forming body 66 has a cylindrical inner tube 78 defining the chamber 68 therein. An outer tubular member 80 is provided radially outwardly of the inner tube 78 joined by a radially extending shoulder 82 to the inner tube 78. The outer tubular member 80 extends outwardly so as to define an annular air space 84 between the outer tubular member 80 and the inner tube 78. The outer tubular member 80 carries threaded flange 86 thereon extending upwardly and outwardly therefrom to define an annular thread space 87 therebetween. The threaded flange 86 engages the threaded neck 62 of the reservoir 18 to form a fluid impermeable seal therewith.

The vacuum relief device 12 in FIGS. 7 and 8 has a configuration substantially identical to that in FIGS. 4 and 5 with coaxial upstanding side wall 36 and upstanding holding tube 46. A cap 32 sealably secured to the upper end of the side wall 36 carries the liquid tube 42 coaxially within the holding tube 46. The upper end of the liquid tube 42 is in communication with fluid in the reservoir. An annular air chamber 43 is defined between the wall 36 and the holding tube 46. Air apertures 41 provide communication between the annular air chamber 43 and the annular air space 84 which is open to atmospheric air. The apertures 41 extend through the shoulder 82 joining the inner tube 78 to the outer tubular member 80. The shoulder 82 may also be considered to join the holding tube 46 to the cylindrical wall 36. The cylindrical wall 36 may be considered an inward extension of the outer tubular member 80. The holding tube 46 may be considered an inward extension of the inner tube 78.

As best seen in FIG. 8, the passageway 74 extends radially outwardly through the holding tube 46 and the cylindrical wall 36 such that the passageway 74 is in open communication with fluid in the reservoir at diametrically opposed positions at both a first open end through one side of the wall 36 and at a second open end through the other side of the wall 36. Fluid from the reservoir is in communication via passageway 74 to the opening 72 to the piston chamber 68. The passageway 74 is defined between a top wall 90 and side walls 91 and 92 with a bottom formed by the shoulder 82 and the inner end 67 of the chamber 68. The top wall 90 forms the floor of the chamber 33 defined within the holding tube 46.

The piston chamber-forming body 66 is preferably injection moulded as a unitary element including the vacuum relief device other than its cap 32 which is preferably formed as a separate injection moulded element. The one-way valve 76 and the piston-forming element 70 are also separate elements.

The one-way valve 76 has a shouldered button 75 which is secured in a snap-fit inside a central opening in the end wall 67 of the chamber 68, a flexible annular rim 77 is carried by the button and extends radially outwardly to the side wall of the inner tube 78. When the pressure in passageway 74 is greater than that in chamber 68, the rim 77 is deflected away from the walls of the inner tube 78 and fluid may flow from passageway 74 through exit openings 72 in the end wall 76 and past the rim 77 into the chamber 68. Fluid flow in the opposite direction is blocked by rim 77.

The piston-forming element or piston 70 is a preferably unitary element formed of plastic. The piston 70 has a hollow stem 90. Two circular discs 91 and 92 are located on the stem spaced from each other. An inner disc 91 resiliently engages the side wall of the chamber 68 to permit fluid flow outwardly therepast but to restrict fluid flow inwardly. An outer disc 92 engages the side walls of the chamber 68 to prevent fluid flow outwardly therepast.

The piston stem 90 has a hollow passageway 93 extending along the axis of the piston 70 from a blind inner end to an outlet 94 at an outer end. Inlets 95 to the passageway 93 are provided between the inner disc 91 and outer disc 92. By reciprocal movement of the piston 70 in the chamber 68, fluid is drawn from passageway 74 through exit openings 72 past the one-way valve 76 and via the inlets 95 through the passageway 93 to exit the outlet 94.

As fluid is pumped from the reservoir 18, a vacuum may be developed in the reservoir and the pressure relief valve 12 may permit air to enter the reservoir 18 in the same manner as described with reference to FIGS. 4 and 5.

The two air apertures 41 shown in FIG. 7 are intended to be relatively small circular openings. FIG. 7 shows a removable closure cap 88 adapted to be secured to the outer tubular member 80 in a snap-fit relation and which is removable to operate the pump. The removable closure cap 88 is shown to be provided with a pendant arm 96 which is secured to the right hand side of the closure cap and extend inwardly to present an inner plug end 97 to sealably engages within an air aperture 41 to sealably close the same. On removal of the closure cap 88, the inner plug end 97 of the pendant arm would be removed from sealing engagement in the air aperture 41. The pendant arm may be hingedly mounted to the closure cap 88 so as to be deflectable to pass outwardly about the piston-forming element 70. The inner plug end 97 may be cammed and guided into the air aperture 41 on applying the closure cap 88 to the outer tubular member 80 as by engagement with the tube 78. While for ease of illustration, only one pendant arm 96 is shown, one such an arm preferably may be provided to close each air aperture 41.

Plugs to close the air apertures 41 could alternatively be a removable element independent of the closure cap 88. As well, the shoulder 82 joining the inner tube 78 to the outer tubular member 80 and the cylindrical wall 36 could be reconfigured and relocated to be at a location outwardly from where it is shown in FIG. 7 such as, for example, to be proximate the inner end 98 of the removable closure cap 88 such that the inner end 98 of the removable closure cap could serve a purpose of sealing the air apertures 41 without the need for separate pendant arms 96.

The embodiment of FIGS. 7 and 8 show a pressure relief device 12 inward of the pump assembly. The pump assembly includes the one-way valve 76 and a piston 70 with two discs 91 and 92 as disclosed in FIG. 9 of U.S. Pat. No. 5,975,360 to Ophardt issued Nov. 2, 1999.

Figure 11:
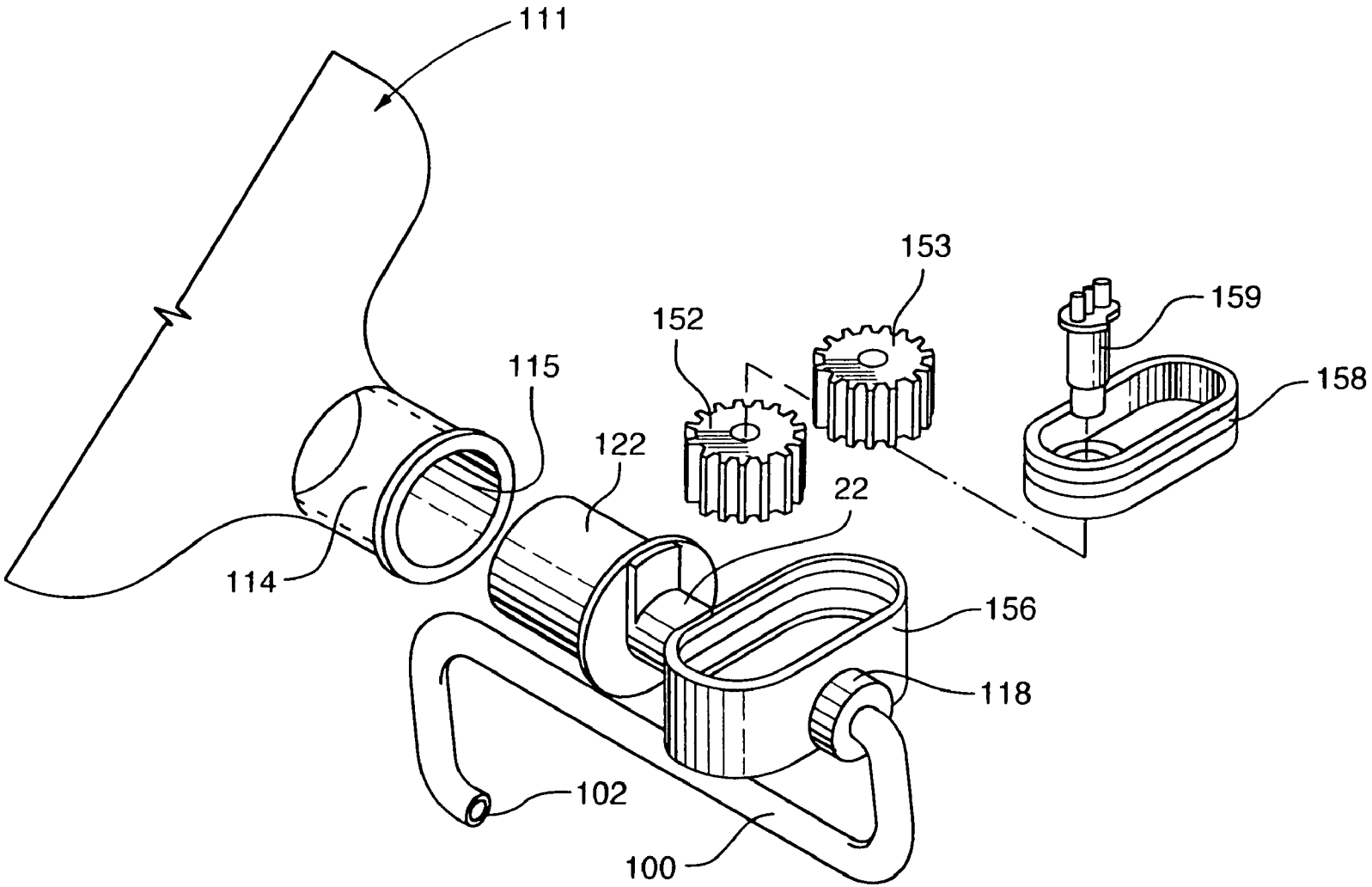
FIG. 11 is an exploded view of components of the dispenser of FIG. 10.

It is to be appreciated that the pump assembly could be substituted with a pump assembly which avoids a separate one-way valve and has three discs which could be used as disclosed, for example, in FIG. 11 of U.S. Pat. No. 5,975,360 which is incorporated herein by reference. Other pump assemblies may be used with the pressure relief device 12 similarly mounted inwardly.

FIGS. 7 and 8 illustrate an embodiment in which a removable dispensing plug is provided in the mouth of the reservoir, the dispensing plug comprising, in combination, a vacuum relief device and pump assembly with the vacuum relief device effectively coaxially disposed inwardly of the pump assembly. This is advantageous for reservoirs with relatively small diameter mouths. With larger mouths, the dispensing plug may have the pump assembly and vacuum relief device mounted side by side. In either case, as seen, the piston chamber-forming element 66 may comprise a unitary element formed by injection moulding and including (a) an element to couple to the mouth of the reservoir, namely, outer tubular member 80, (b) the inner tube 78 to receive the piston 70, (c) the side wall 36, and (d) the holding tube 46.

Figure 9:
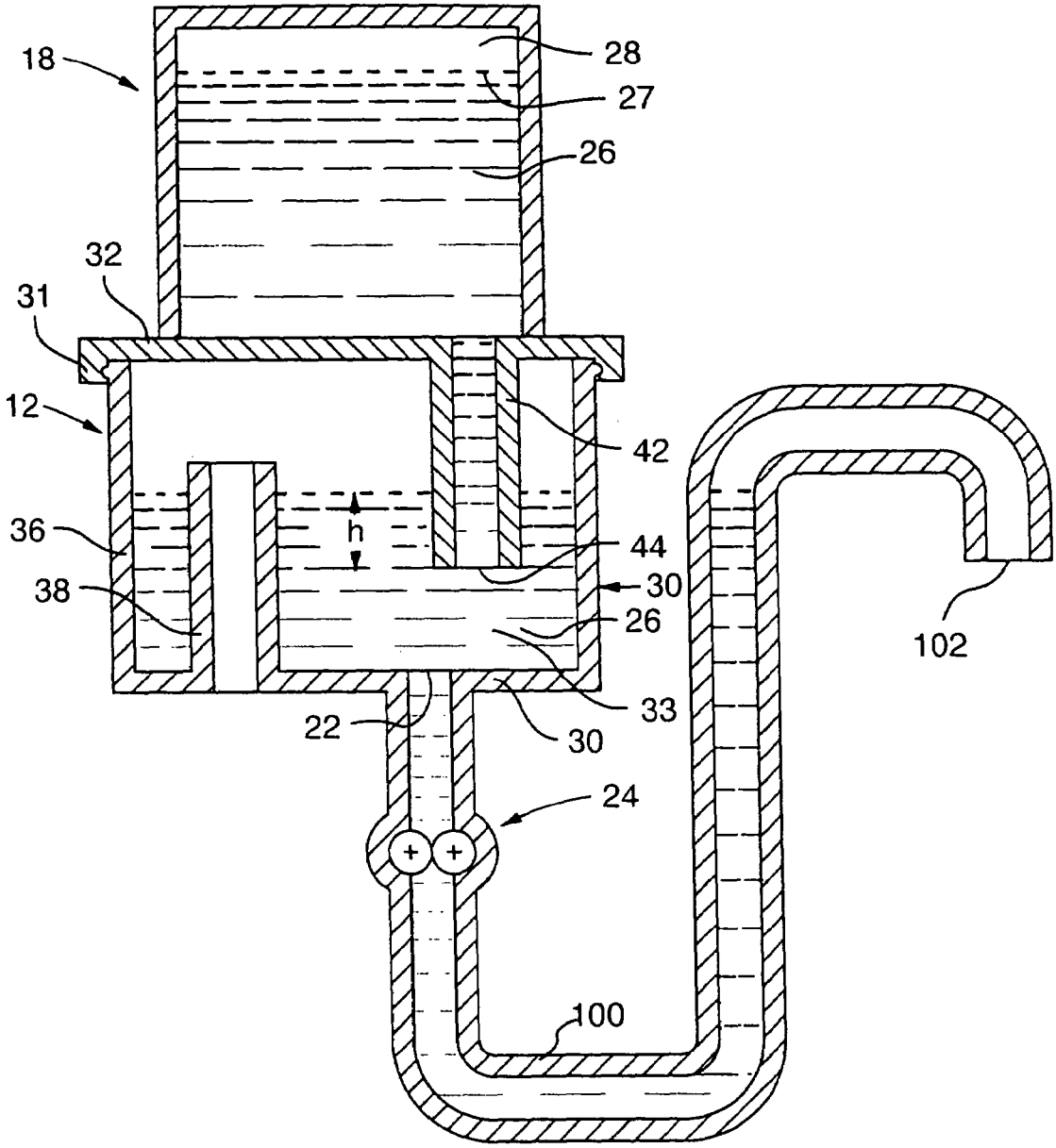
FIG. 9 is a schematic cross-sectional view of a fluid dispenser including a vacuum relief device in accordance with a fifth embodiment of the present invention.

Reference is made to FIG. 9 which schematically shows an embodiment in accordance with the present invention very similar to that shown in FIGS. 1 to 3, however, with the pump 24 disposed so as to draw fluid from the chamber 33 rather than from the reservoir 18. In this regard, the outlet 22 for the pump 24 is shown as being provided to extend from the base 30 at a height below the liquid inlet 44. Fluid from the pump 24 flows via an outlet tube 100 to an outlet 102.

FIG. 9 shows the reservoir 18, the vacuum relief device 12 and the outlet 102 at preferred relative heights in accordance with the present invention. FIG. 9 shows a condition in which the pump is not operating and the level of the liquid 26 assumes in the outlet tube 100 as being at a height which is effectively the same as the height of the level of the liquid 26 in the chamber 33. The height of the level of the liquid 26 in the chamber 33 and, therefore, in the outlet tube 100, is selected to be below the height of the outlet 102. With this arrangement, liquid does not have a tendency to drip out the outlet 102 even though liquid in the reservoir 18 is at a height above the outlet 102. This configuration is particularly advantageous for use with relatively low viscosity liquids such as alcohol solutions as are used in disinfecting and hand cleaning in hospitals. Dispensers for such alcohol solutions frequently suffer the disadvantage that the alcohol will drip out of the outlet and, while it has previously been known in the past to provide the outlet for the alcohol at a height above the level of alcohol in the reservoir, this is, to some extent, impractical and increases the pressure with which the alcohol needs to be pumped by the pump to be moved to a height above the height of the alcohol in the reservoir. In accordance with the embodiment illustrated in FIG. 9, the pressure relief device 12 can be of relatively small dimension and, therefore, the outlet 102 needs only be raised a relatively small amount to place the outlet 102 at a height above the level of the liquid 26 in the chamber 33. For example, the height of a typical reservoir is generally in the range of six to eighteen inches whereas the height of the vacuum relief device 12 may be only in the range of about one inch or less.

FIG. 9 schematically illustrates the pump 24. This pump may preferably comprise a pump as disclosed in the applicant's U.S. Pat. No. 5,836,482, issued Nov. 17, 1998 to Ophardt and U.S. Pat. No. 6,343,724, issued Feb. 5, 2002 to Ophardt, the disclosures of which are incorporated herein by reference. Fluid dispensers with such pumps preferably have configurations to reduce the frictional forces arising in fluid flow which need to be overcome by the pump so as to increase the useful life of batteries and, therefore, minimize the size and quantities of batteries used. The embodiment illustrated in FIG. 9 has the advantage that a one-way valve is not required to prevent dripping from the outlet and, thus, during pumping, there is a minimum of resistance to fluid flow since fluid may flow directly from the reservoir to the chamber 33, from the chamber 33 to the pump 24 and, hence, from the pump 24 via the outlet tube 100 to the outlet 102. The relative height of the outlet 102 above the height of the liquid inlet 44 ensures there will be no dripping. Thus, the vacuum relief device 12 as used in the context of FIG. 9 not only serves a purpose of providing a convenient structure to permit air to pass upwardly into the reservoir 18 to relieve any vacuum developed therein, but also provides an arrangement by which a mechanical valve is not required to prevent dripping and in which the height at which the outlet must be located is below the height of the liquid in the reservoir 18 and merely needs to be above the height of the liquid in the chamber 33.

While the schematic embodiment illustrated in FIG. 9 shows the pump as disposed below the vacuum relief device 12, it is to be appreciated that the pump could readily be disposed to one side, further reducing the length of the outlet tube.

Figure 10:
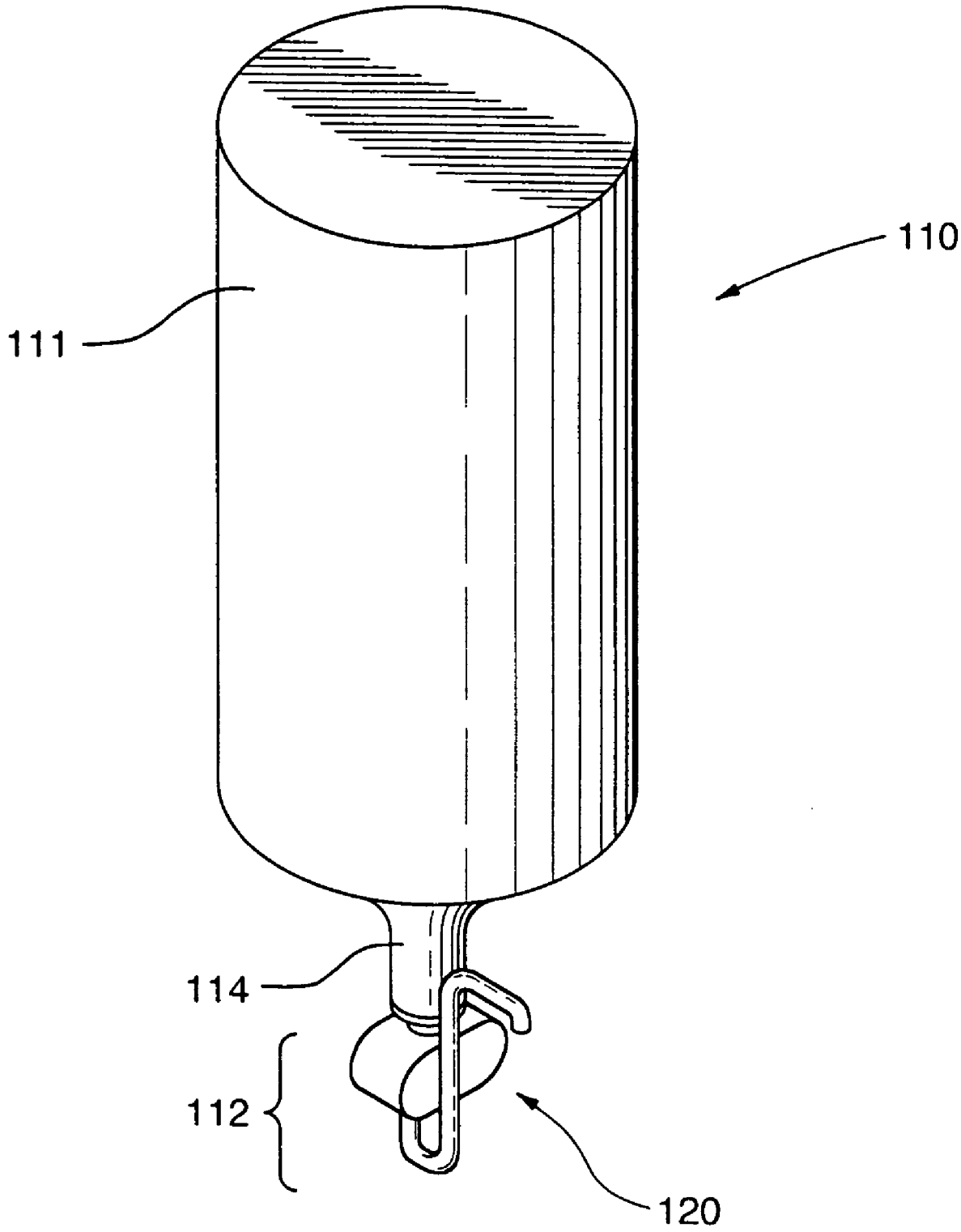
FIG. 10 is a pictorial view of a fluid dispenser in accordance with a sixth embodiment of the present invention.
Figure 12:
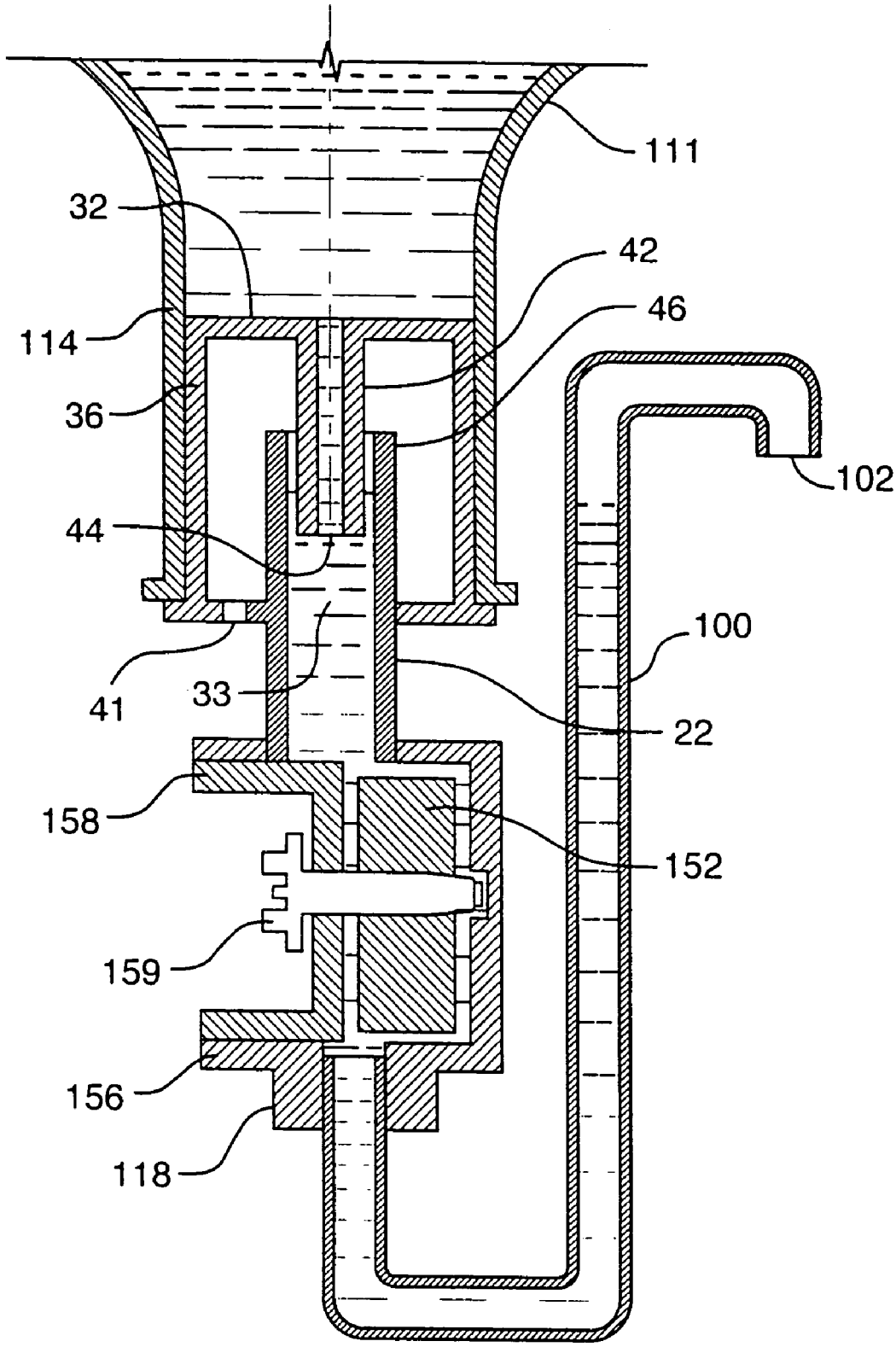
FIG. 12 is a vertical cross-sectional view through the dispenser of FIG. 10.

FIGS. 10, 11 and 12 show an arrangement as taught in FIG. 9 utilizing as the pump a pump in U.S. Pat. No. 6,343,724, the disclosure of which is incorporated herein by reference. The dispenser generally indicated 110 includes a non-collapsible fluid container 111 with outlet member 114 providing an exit passageway 115 for exit of fluid from the container 111.

The pump/valve assembly 112 is best shown as comprising several separate elements, namely, a feed tube 122, a pump 120 and an outlet tube 100. The pump 120 includes a pump casing 156, a drive impeller 152, a driven impeller 153, a casing plug 158 and a drive shaft 159.

The cylindrical feed tube 122 is adapted to be received in sealing engagement in the cylindrical exit passageway 115 of the outlet member 114. The feed tube 122 incorporates a vacuum relief device in accordance with the present invention and the cylindrical feed tube 122 is best seen in cross-section in FIG. 12 to have a configuration similar to that in FIG. 4, however, with the notable exception that the outlet 22 is provided as a cylindrical outer extension of the holding tube 46. The cap 32 is provided to be located in a snap-fit internally within the cylindrical side walls 36. The outlet 22 leads to the pump 120 from which fluid is pumped by rotation of the impellers 152 and 153. The outlet tube 100 is a separate element frictionally engaged on a spout-like outlet 118 on the pump casing 156. The outlet tube 100 has a generally S-shaped configuration and extends upwardly so as to provide its outlet 102 at a height above the height of the liquid inlet 44. As seen in FIG. 12, the fluid in the outlet tube 100 assumes the height of the fluid in the chamber 33 which is below the height of the outlet 102 so that there is no dripping out of the outlet 102.

The embodiment of FIG. 12 is particularly advantageous for liquids of low viscosity such as alcohol and water based solutions in which dripping can be an increased problem. The embodiment of FIG. 12 does not require a mechanical one-way valve to prevent dripping and can have fluid dispensed though it with minimal effort. The dispenser illustrated is easily primed and will be self-priming since the gear pump is a pump which typically, when it is not operating, permits low viscosity fluids to slowly pass therethrough. As disclosed in U.S. Pat. No. 6,343,724, the drive shaft 159 is adapted to be coupled to a motor, preferably a battery operated motor, maintained in a dispenser housing. The entirety of the pump assembly shown in FIG. 12 can be made of plastic and be disposable.

Figure 13:
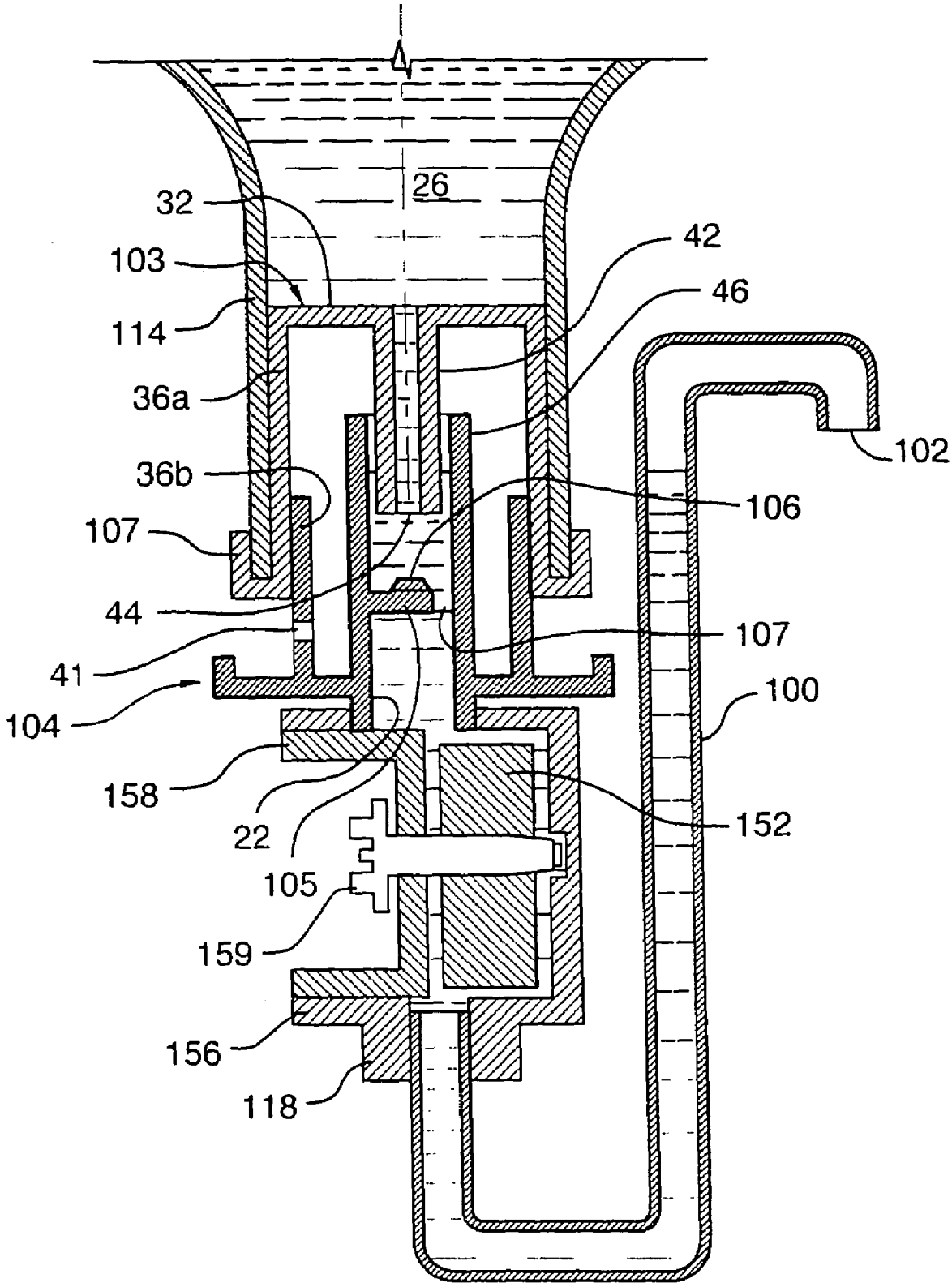
FIG. 13 is a vertical cross-section through a dispenser in accordance with a seventh embodiment of the present invention similar to the embodiment shown in FIG. 12 and in an open position.
Figure 14:
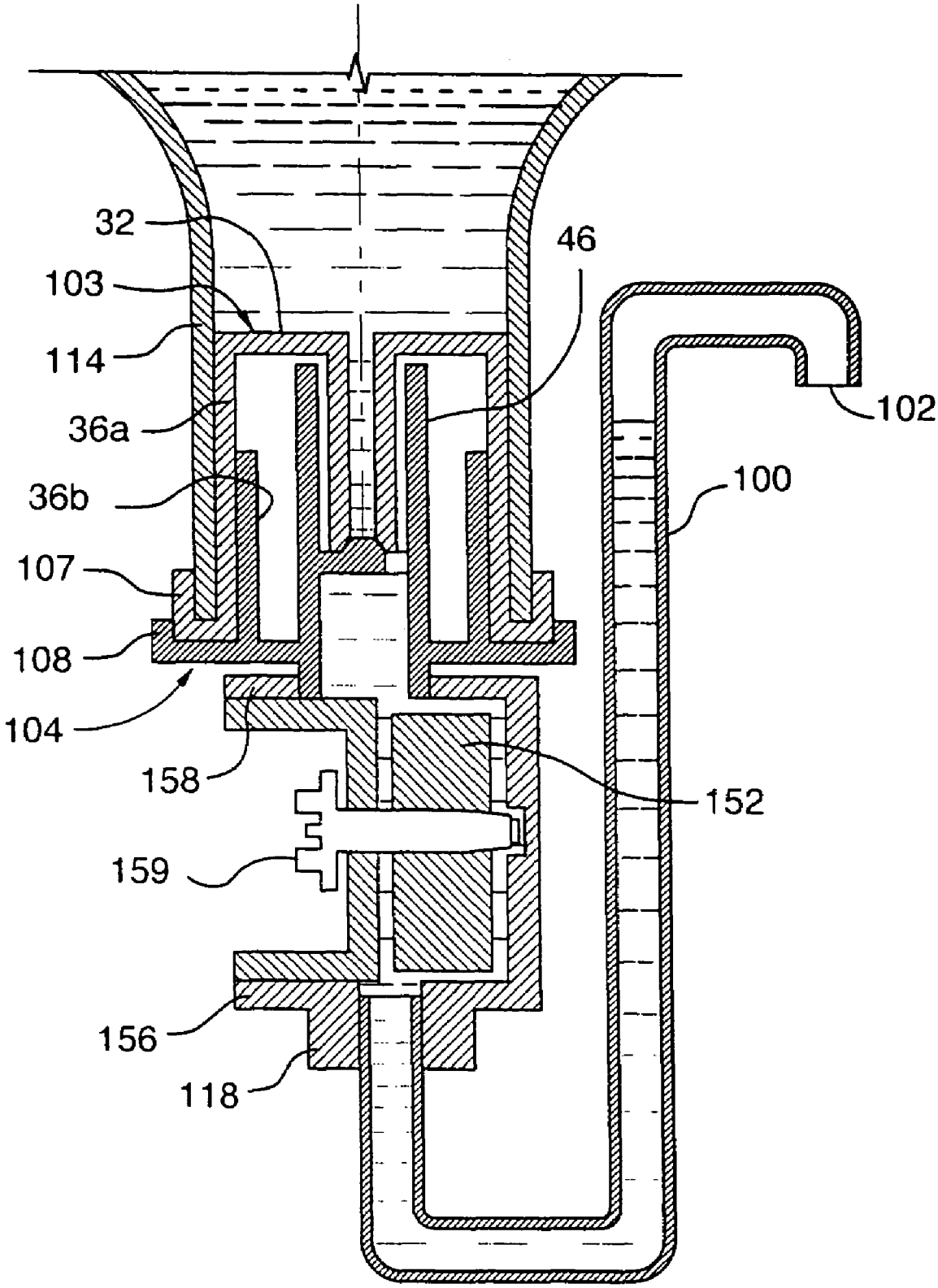
FIG. 14 is a vertical cross-sectional of the dispenser of FIG. 13 in a closed position.

Reference is made to FIGS. 13 and 14 which show a modified form of the dispenser of FIG. 12. The embodiment of FIGS. 13 and 14 is identical to that of FIG. 12 with the exception that the pressure relief device is made from two different parts, namely, an inner element 103 and an outer element 104. The inner element 103 is a unitary element comprising the cap 32 merged with an outer cylindrical wall 36*a* ending at an outwardly extending cylindrical opening. The outer element 104 includes the holding tube 46, the exit tube 22 and the base 30 merged with an inner cylindrical wall 36*b* ending at an inwardly extending cylindrical opening. An air aperture 41 is provided in an outermost portion of the inner cylindrical wall 36*b*. The outer element 104 is coaxially received in the inner element 103 for relative axial sliding between the open position of FIG. 13 to the closed position of FIG. 14. The inner and outer cylindrical walls 36*b* and 36*a* engage each other to form a fluid impermeable seal therebetween.

The outer element 104 includes within the holding tube 46 a disc-like closure member 105 carrying an inwardly extending central plug 106 to engage the liquid inlet 44 and close the same. Radially outwardly of the central plug 106, the closure member 105 has an opening 107 therethrough for free passage of the fluid 26.

In open position as shown in FIG. 13, the pressure relief valve 12 functions identically to the manner in FIG. 12. In the closed position of FIG. 14, the plug 106 engages the liquid inlet 44 and prevents flow of fluid from the reservoir 18 via liquid tube 42. As well, in the closed position of FIG. 14, the air aperture 41 is closed by being covered by the outer cylindrical wall 36*a*. Various mechanisms may be provided to releasably lock the outer element 104 in the locked and unlocked positions. In the axial sliding of the inner element 103 and outer element 104, the plug 106 acts like a valve movable to open and close a liquid passageway through the liquid tube 42. Similarly, the outer cylindrical wall 36*a* acts like a valve movable to open and close an air passageway through the air aperture 41.

FIGS. 13 and 14 show the inner element 103 carrying on its outer cylindrical wall 36*a* a lip structure 107 to engage the mouth of the container's outlet member 114 in a snap friction fit relation against easy removal.

The outer element 104 is also shown to carry on its inner cylindrical wall 36*b* a lesser lip structure 108 to engage the inner element 103 and hold the outer element 104 in a closed position until the lip structure 108 may be released to move the outer element 104 to the open position. Various other catch assemblies, thread systems and fragible closure mechanisms may be utilized.

The container 111 filled with liquid with its outlet member 114 directed upwardly may have a pump assembly as shown in FIG. 14 applied thereto in a closed position to seal the fluid in the container. For use, the container may be inverted and the outer element 104 moved axially outwardly to the open position of FIG. 13. Preferably, a dispenser housing to receive the container 111 with the pump assembly attached may require, as a matter of coupling of the container and pump assembly to the housing, that the outer element 104 necessarily be moved to the open position of FIG. 13.

Each of the inner element 103 and outer element 104 may be an integral element formed from plastic by injection moulding.

Reference is made to FIGS. 15 to 19 which shows another embodiment of a fluid dispenser in accordance with the present invention.

Figure 15:
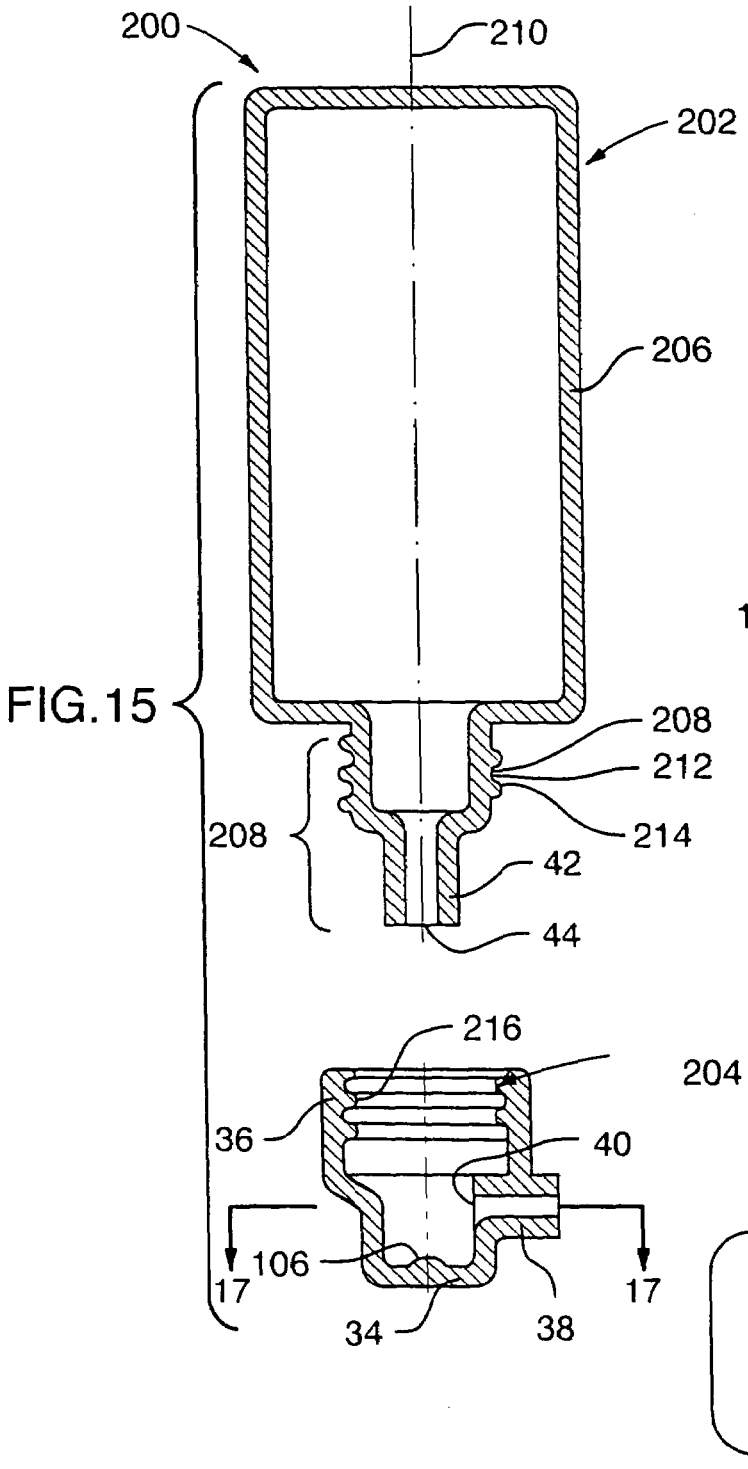
FIG. 15 is an exploded side view of a liquid dispenser in accordance with an eighth embodiment of the present invention.
Figure 17:
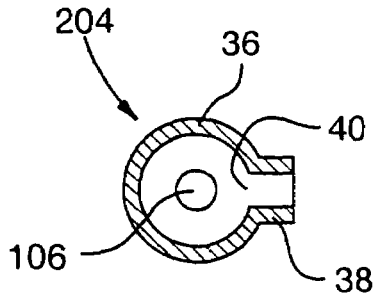
FIG. 17 is a cross-sectional end view of the cap shown in FIG. 15 along section line A–A'.

FIG. 15 shows the dispenser 200 including a bottle 202 and a cap 204.

Figure 16:
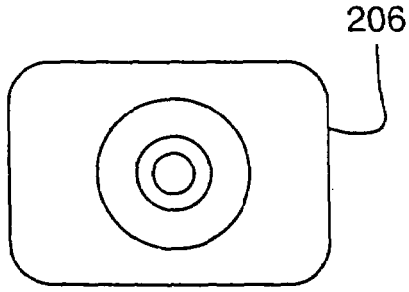
FIG. 16 is an end view of the bottle shown in FIG. 15.

The bottle 202 has a body 206 which is rectangular in cross-section as seen in FIG. 16 and a neck 208 which is generally circular in cross-section about a longitudinal axis 210. The neck 208 includes a threaded inner neck portion 212 carrying external threads 214. The inner portion 212 merges into a liquid tube 42 of reduced diameter.

The cap 204 has a base 34 with a cylindrical side wall 36 carrying internal threads 216 adapted to engage the threaded neck portion 212 in a fluid sealed engagement. An air tube 38 extends radially from the side wall 36. A central plug 106 is carried on the base 34 upstanding therefrom. In an assembled closed position as seen in FIG. 18, the cap 204 is threaded onto the neck 208 of the bottle 202 to an extent that the plug 106 engages the end of the liquid tube 42 and seals the liquid tube 42 so as to prevent flow of fluid into or out of the bottle 202.

From the position of FIG. 18, by rotation of the cap 204 180° relative the bottle 202, the cap 204 assumes an open position in which the neck of the bottle and the cap form a vacuum relief device with the liquid tube 42 having a liquid inlet 44 at a height below the height of an air inlet 40 at the inner end of the air tube 38. With the bottle in the inverted position with its neck down as shown, cap and neck will function not only as a vacuum relief valve but also as a dispensing outlet. In this regard, the bottle 202 is preferably a resilient plastic bottle as formed by blow moulded which has an inherent bias to assume an inherent shape having an inherent internal volume. The bottle may be compressed as by having its side surfaces moved inwardly so as to be deformed to shapes different than the inherent shape and having volumes less than the inherent volume but which, on removal of compressive fences, will assume its original inherent shape.

Figure 18:
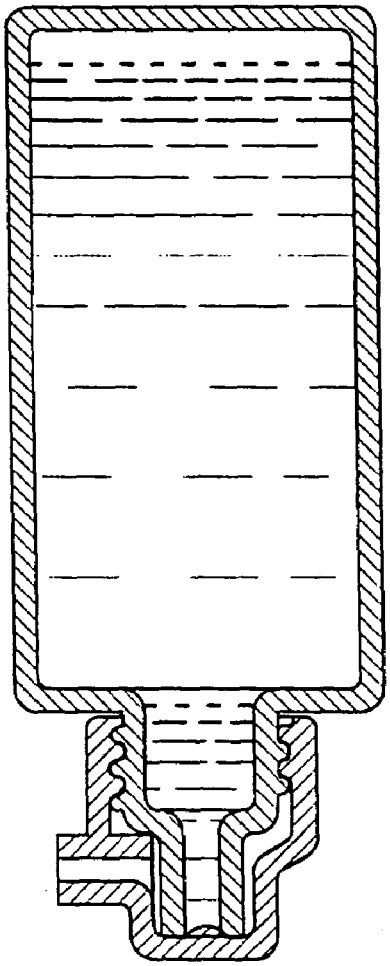
FIG. 18 is a side view of the liquid dispenser of FIG. 15 in a closed position.

With the bottle in the position of FIG. 18 on compressing the bottle, as by manually squeezing the bottle, fluid 26 in the bottle is pressurized and forced to flow out of the liquid tube 42 into the chamber 33 in the cap 202 and, hence, out the air tube 38. On ceasing to compress the bottle, the bottle due to its resiliency, will attempt to resume its normal shape and, in so doing, will create a vacuum in the bottle, in which case the liquid tube 42 and air tube 38 in the cavity 33 will act like a vacuum relief valve in the same manner as described with the embodiment of FIGS. 1 to 6.

The bottle and cap may be mounted to a wall by a simple mounting mechanism and fluid dispensed merely by a user pushing on the side of the bottle into the wall. The bottle and cap could be mounted within an enclosing housing with some mechanism to apply compressive forces to the side of the bottle, as in response to movement of a manual lever or an electrically operated pusher element.

Figure 19:
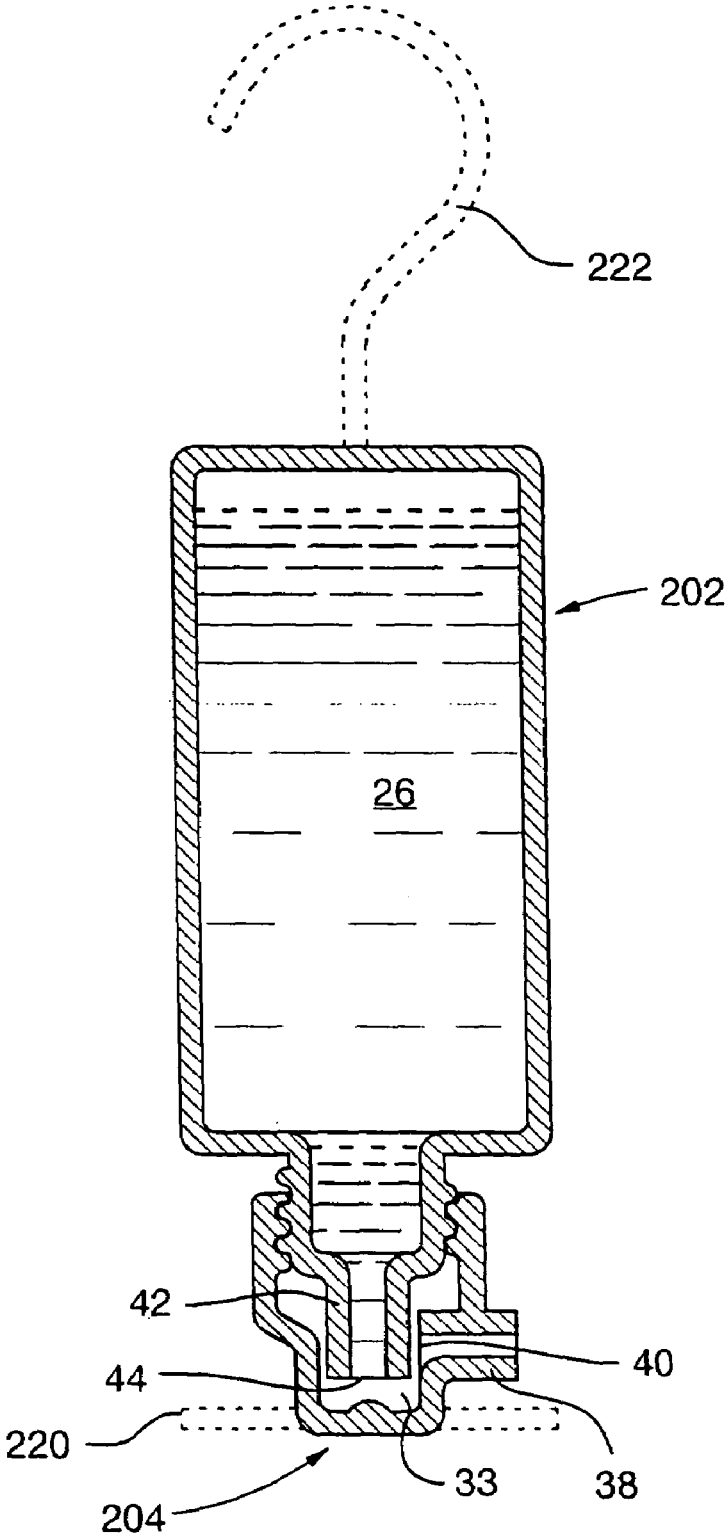
FIG. 19 is a side view of the liquid dispenser of FIG. 15 in an open position.

The bottle and cap may be adapted to be stored ready for use in the open position inverted as shown in FIG. 19 and an extension of the base 34 of the cap 204 is shown in dotted lines as 220 to provide an enlarged platform to support the bottle and cap inverted on a flat surface such as a table. In use, the bottle and cap may be kept in an inverted open position and liquid will not drip out since the liquid in the chamber 33 will assume a level below the liquid inlet 42 and the air inlet 40. Alternatively, a hook may be provided, as shown in dashed lines as 222 in FIG. 9, to hang the bottle and cap inverted in a shower. The bottle and cap need be closed merely for shipping and storage before use.

Figure 20:
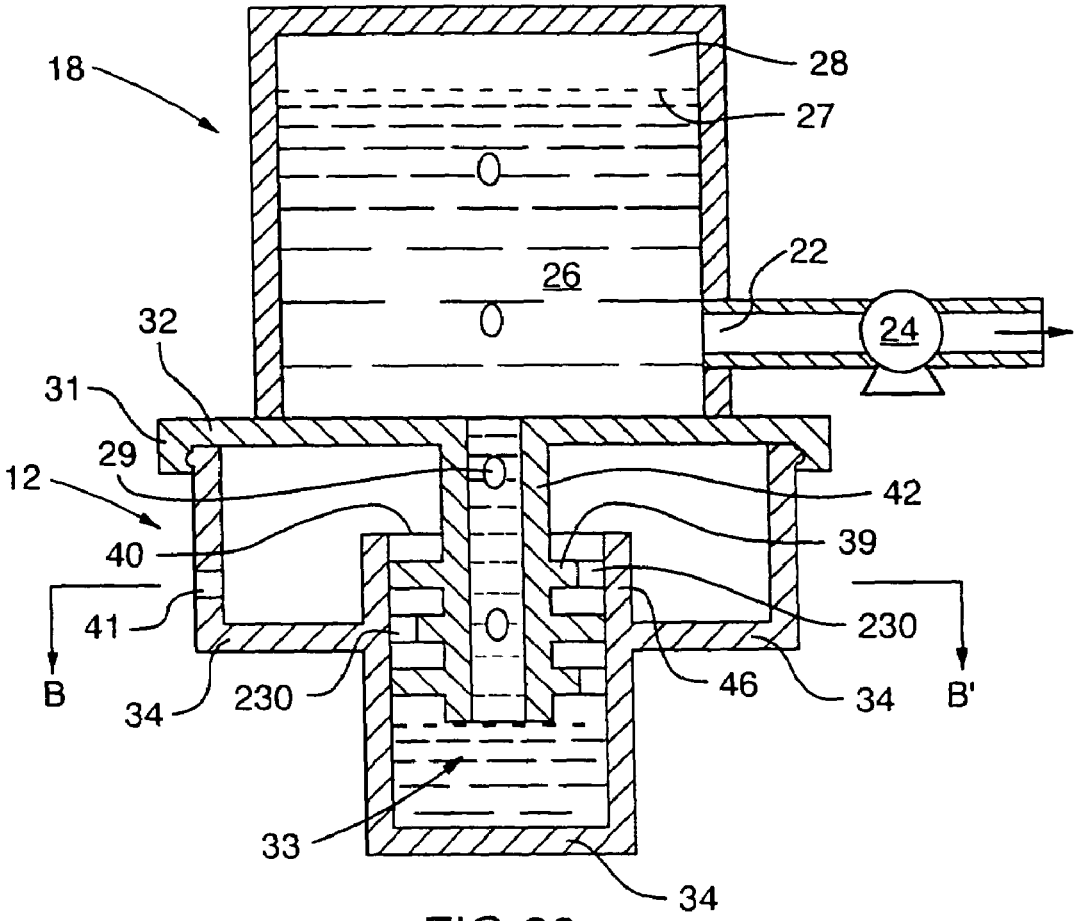
FIG. 20 is a schematic cross-sectional view for a fluid dispenser substantially the same as that shown in FIG. 4.
Figure 21:
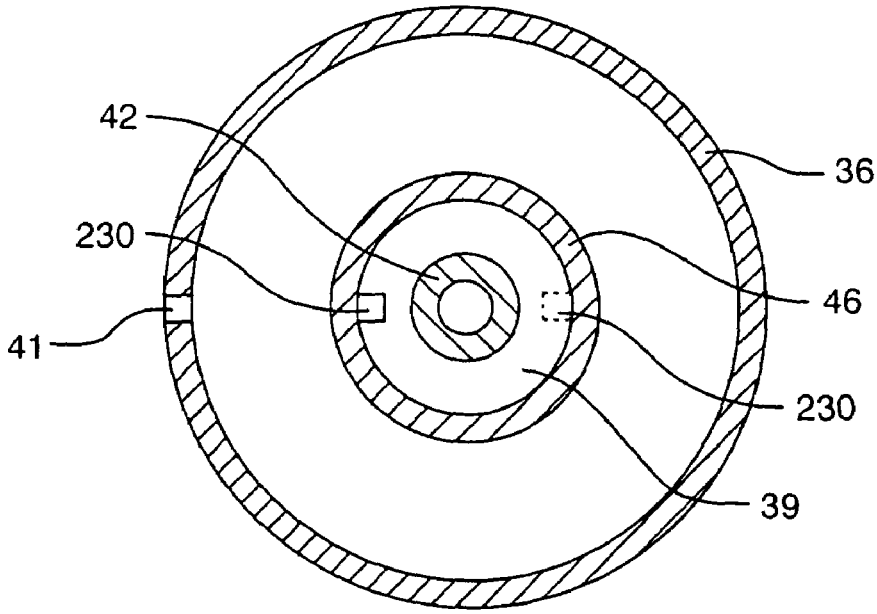
FIG. 21 is a cross-sectional view through FIG. 4 along section line B–B'.

Reference is made to FIGS. 19 and 20 which shows a device identical to that in FIGS. 4 and 5 but for firstly, the location of the air aperture 41 in the side wall 36, secondly, providing the base 34 to be at different heights under the holding tube 46 than under the annular air passageway 43 and, thirdly, the liquid tube 42 carries on its outer surface a plurality of spaced radially outwardly extending annular rings 39 which extend to the tube 46. Each ring has an opening 230 adjacent its outer edge to permit flow between the tube 42 and the tube 46.

The openings 230 on alternate rings are disposed 180° from each other to provide an extended length flow path for fluid flow through the passageway between liquid tube 42 and holding tube 46.

These annular rings are not necessary. They are intended to show one form of a flow restriction device which may optionally be provided to restrict flow of liquid but not restrict flow of air therethrough. The purpose of the annular rings is to provide reduced surface area for flow between the liquid tube 42 and the holding tube 46 as through relatively small spaces or openings with the spaces or openings selected to not restrict the flow of air but to provide increased resistance to flow of liquids, particularly viscous soaps and the like, therethrough. This is perceived to be an advantage in dispensers where liquid flow out of air inlet 40 is not desired, should a condition arise in which liquid is attempting to pass from inside the tube 42 through the inside of tube 40 and out of the air inlet 40 or air opening 41. Having increased resistance to fluid flow may be of assistance in reducing flow leakage out of the air apertures 41 under certain conditions.

Reference is made to FIGS. 22 to 28 which show a ninth embodiment of a fluid dispenser in accordance with the present invention.

Figure 22:
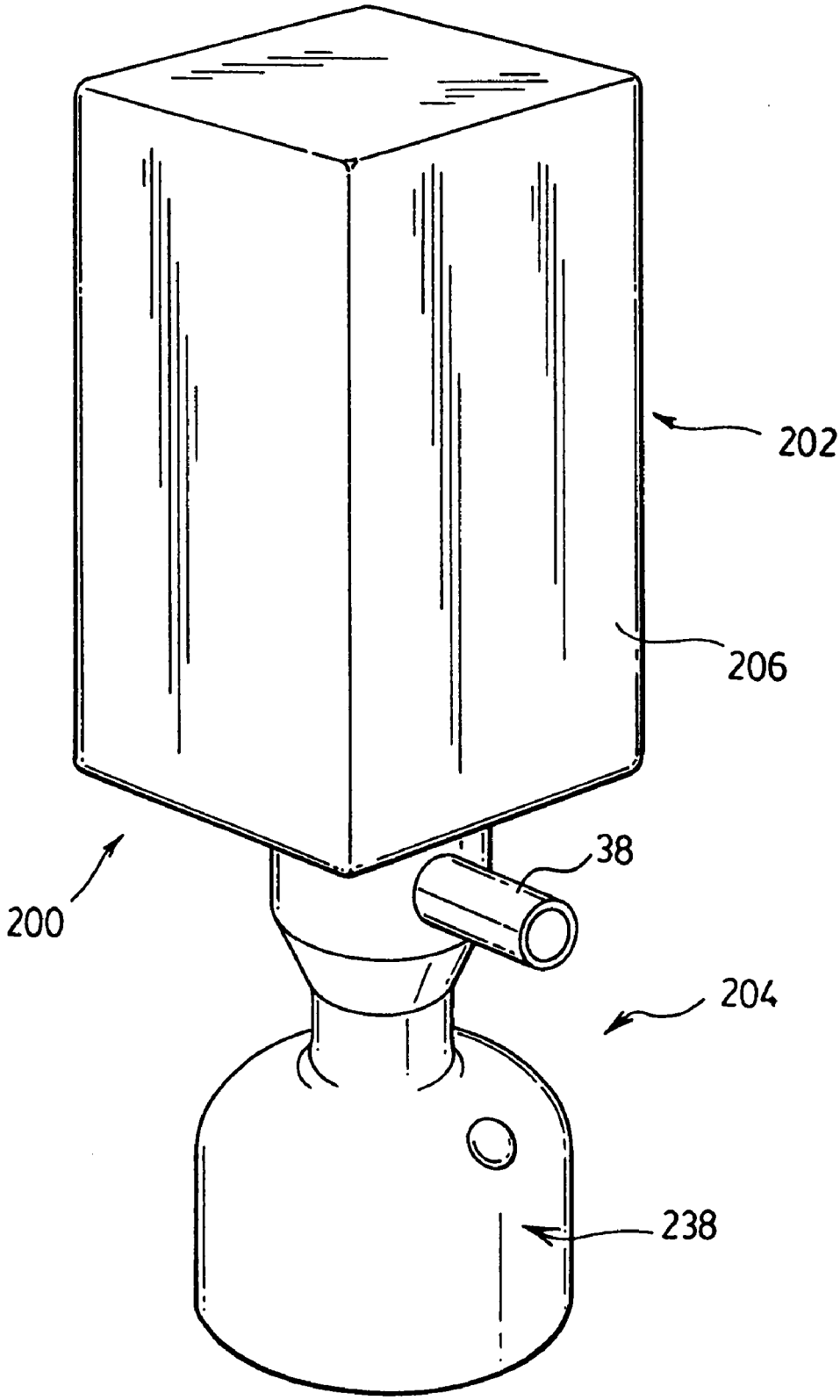
FIG. 22 is a perspective view of a soap dispenser in accordance with a ninth embodiment of the present invention.
Figure 23:
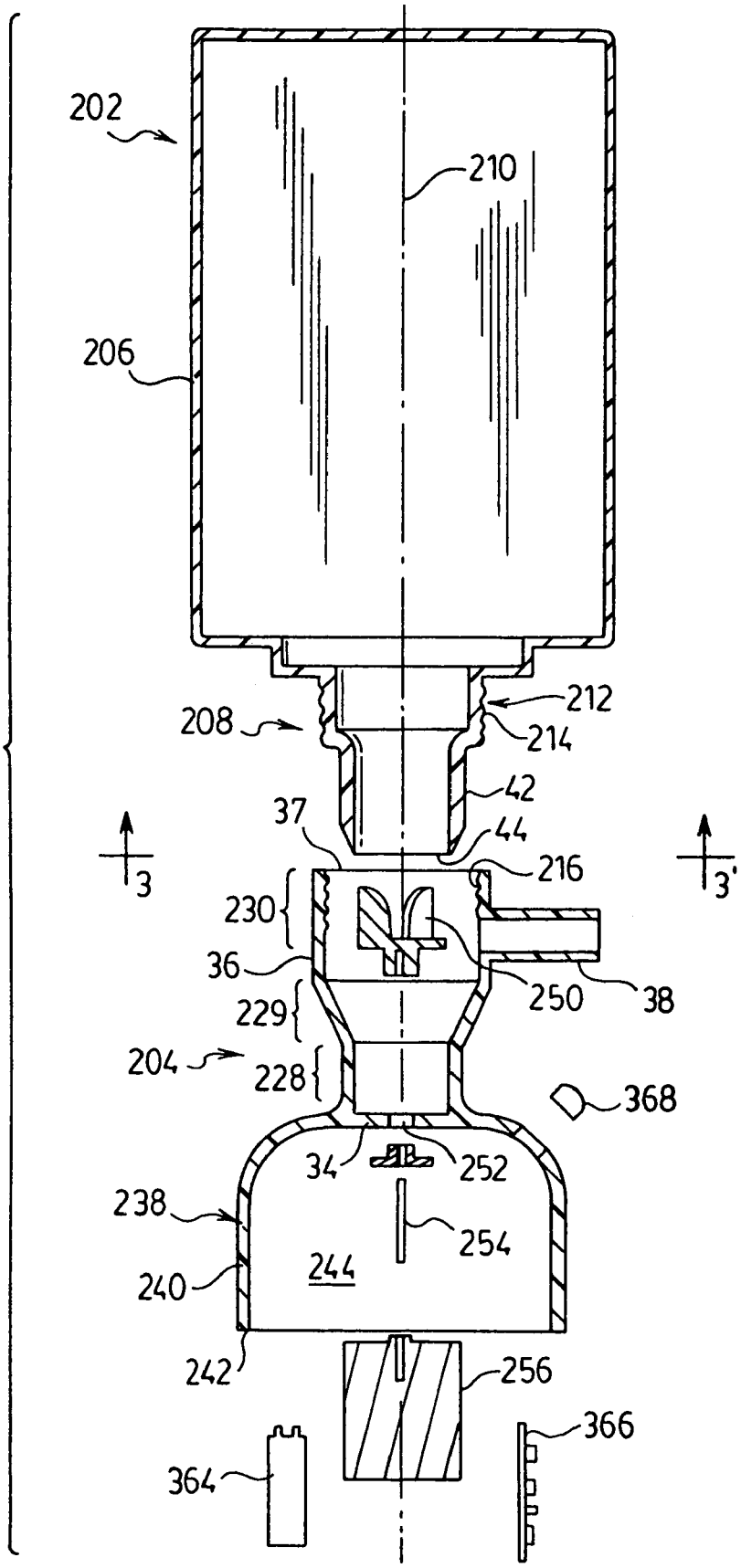
FIG. 23 is a schematic exploded partially cross-sectional view of the soap dispenser of FIG. 1.

FIG. 22 shows the dispenser 200 including a bottle 202 and a cap 204.

Figure 24:
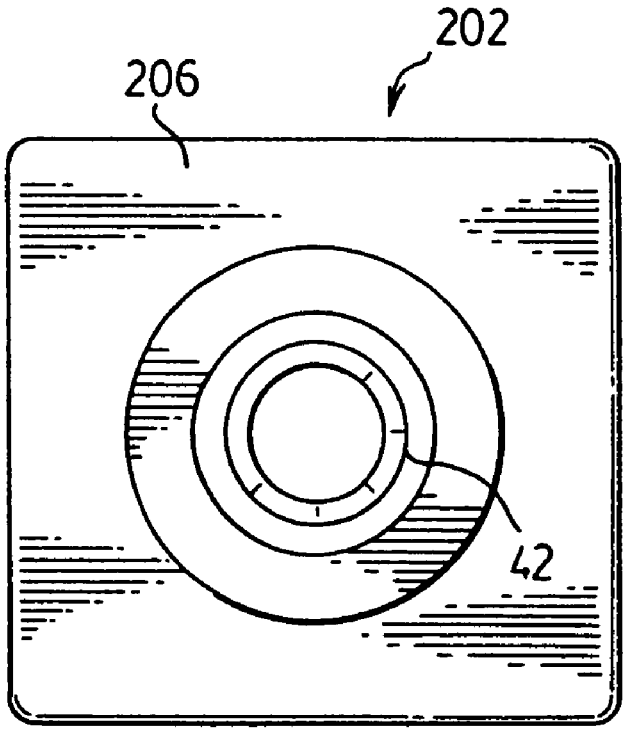
FIG. 24 is a end view of the bottle as seen in cross-section 3–3' in FIG. 3.
Figure 25:
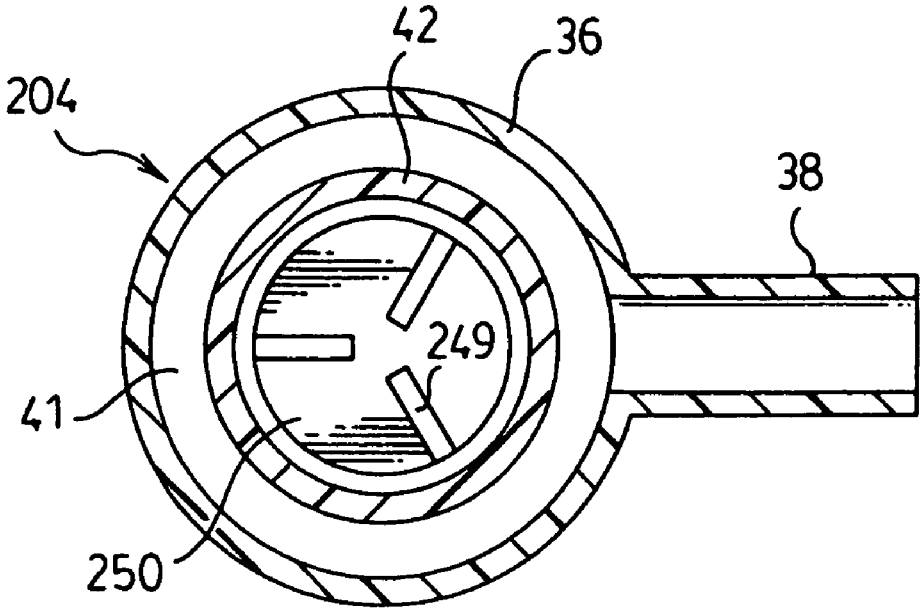
FIG. 25 is a cross-sectional view through the cap as seen along section line 4–4' in FIG. 5.

The bottle 202 has a body 206 which is rectangular in cross-section as seen in FIG. 24 and a neck 208 which is generally circular in cross-section about a longitudinal axis 210. The neck 208 includes a threaded inner neck portion 212 carrying external threads 214. The inner portion 212 merges into a liquid tube 42 which ends at the container outlet opening 44.

The cap 204 has a base 34 from which a side wall 36 extends upwardly to a remote upper opening 37. The side wall 36 includes a remote upper portion 230 carrying internal threads 216 adapted to engage the threaded neck portion 212 of the bottle 202 in a fluid sealed engagement. An air tube 38 extends radially from the side wall 36. The side wall 36 has a cylindrical lowermost portion 228 rising up from the base 34 and merging into an upwardly opening frustoconical portion 229 which merges at its upper end with the remote cylindrical portion. The air tube 38 extends radially from the uppermost remote portion below the threads 216.

The cap includes a supporting portion 238 having a side wall 240 which extends outwardly and downwardly from about the base 34 to a planar support surface 242 adapted to engage a planar desktop or work surface or the like and support the dispenser in a vertical orientation as shown. A chamber 244 is defined within the supporting portion 238.

An impeller 250 is provided within the cap 204 above the base 34 and inside the cylindrical side wall 36. The impeller 250 is arranged for rotation about the axis 210. In this regard in the preferred embodiment, a shaft opening 252 is provided coaxially of the axis 210 through the base 34. A shaft 254 extends through this opening 252 and is coupled at its upper end to the impeller 250 and at its lower end to a motor 256 securely supported within the chamber 244. A sealing ring is disposed about the shaft 254 in the opening 252 providing a fluid impermeable seal to prevent liquid from passing outwardly through the opening 252. When the motor 256 is activated, the impeller rotates about the axis 210.

Figure 26:
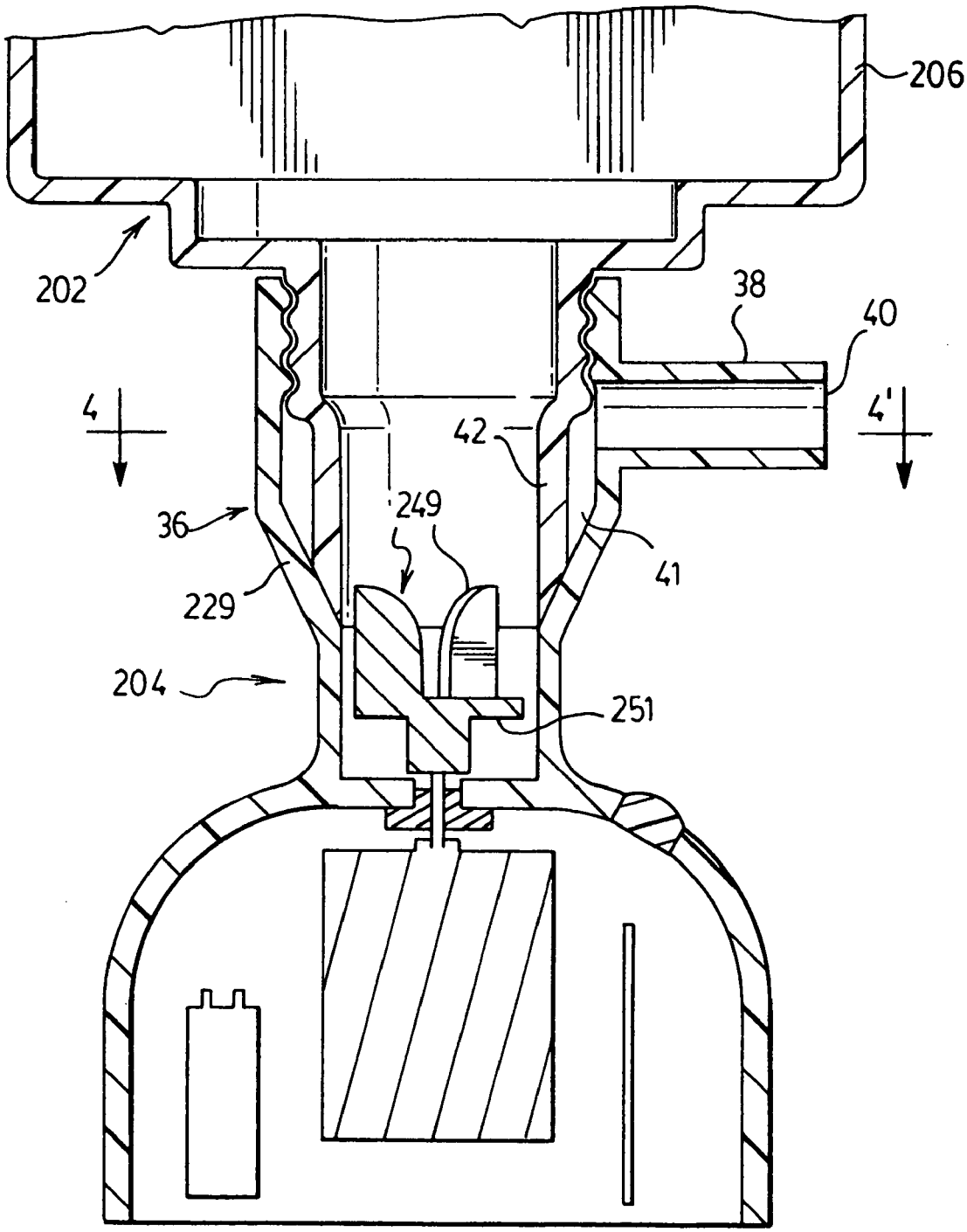
FIG. 26 is a partial cross-sectional view of the soap dispenser of FIG. 1 in a closed condition.

Reference is made to FIG. 26 which shows the dispenser in an assembled closed position. In this position, the neck 208 of the bottle 202 is threaded downwardly into the cap 204 to an extent that the lower periphery of the liquid tube 42 of the bottle engages the interior surface of the frustoconical portion 229 of the side wall 36 and seals the liquid tube 42 so as to effectively prevent the flow of fluid into or out of the bottle 202.

From the position of FIG. 26, by relative rotation of the bottle 202 relative the cap, as preferably 180 degrees, an open position is assumed in which the inlet 44 of the liquid tube 42 of the neck of the bottle is displaced vertically from the side wall 36 of the cap in a manner which will permit flow of fluid and/or air into and/or out of the bottle. In the open position of FIG. 27, the cap 204 and the neck 208 of the bottle cooperate to function as vacuum relief valve.

In this regard, the bottle 202 is preferably a resilient plastic bottle, as formed by blow molding, which has an inherent bias to assume an inherent shape having an inherent internal volume. The bottle may be compressed as by having its side surface moved inwardly so as to be deformed to shapes different than the inherent shape. The bottle may be deformed to shapes different than the inherent shape with volumes less than inherent volume and from which deformed shapes the bottle will have an inherent bias to assume its original inherent shape.

In combination, the cap 204 and the neck 208 of the bottle form an enclosed chamber 33 having an air inlet 40 via air tube 38 in communication with air at atmospheric pressure and a liquid inlet 44 in communication with liquid in the reservoir bottle 202 via the liquid tube 42. The liquid inlet 44 is open to the chamber 33 at a height which is below a height at which the air inlet 40 opens into the chamber 33.

Figure 27:
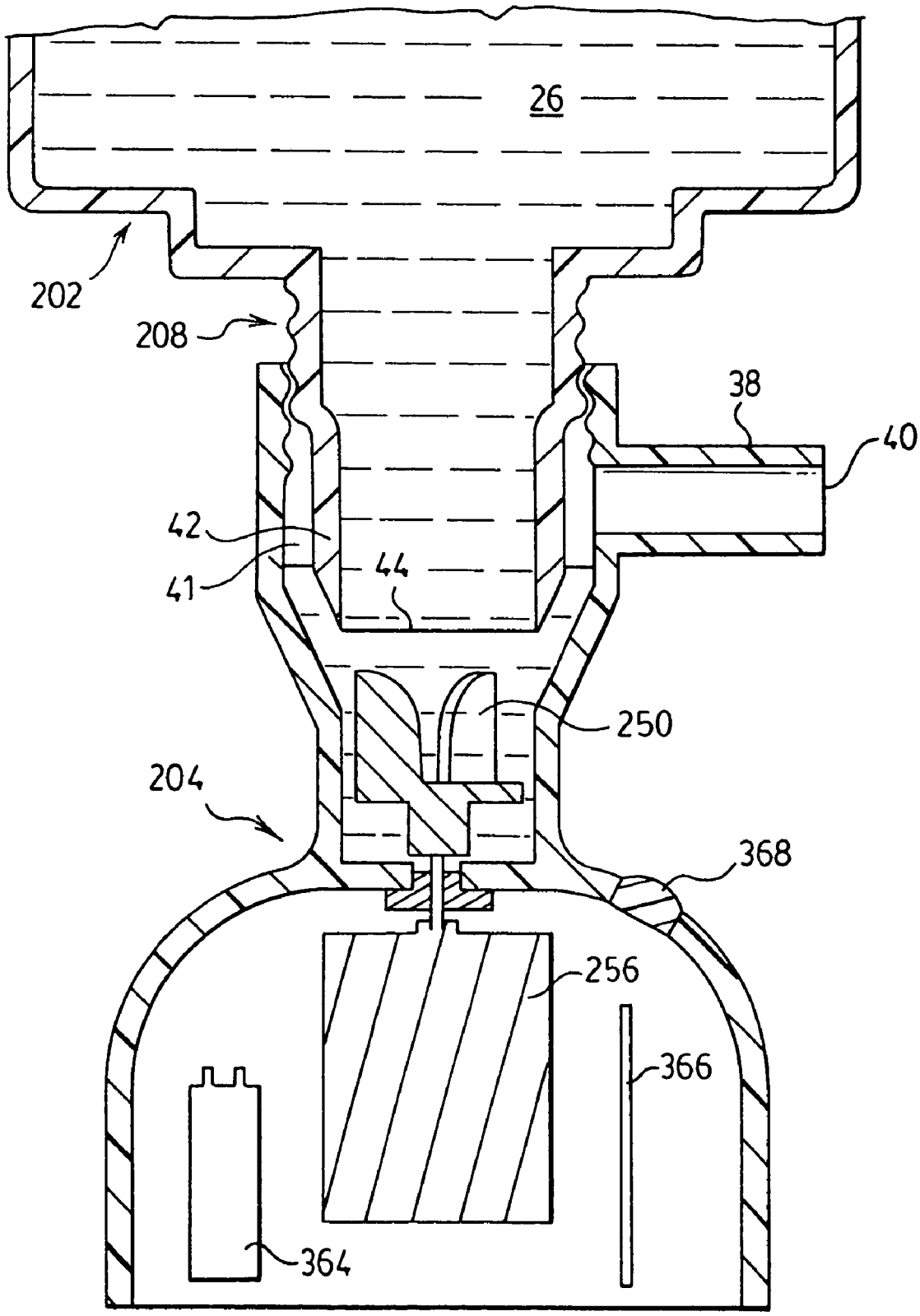
FIG. 27 is a view similar to that in FIG. 3 but showing the soap dispenser in an open position.
Figure 28:
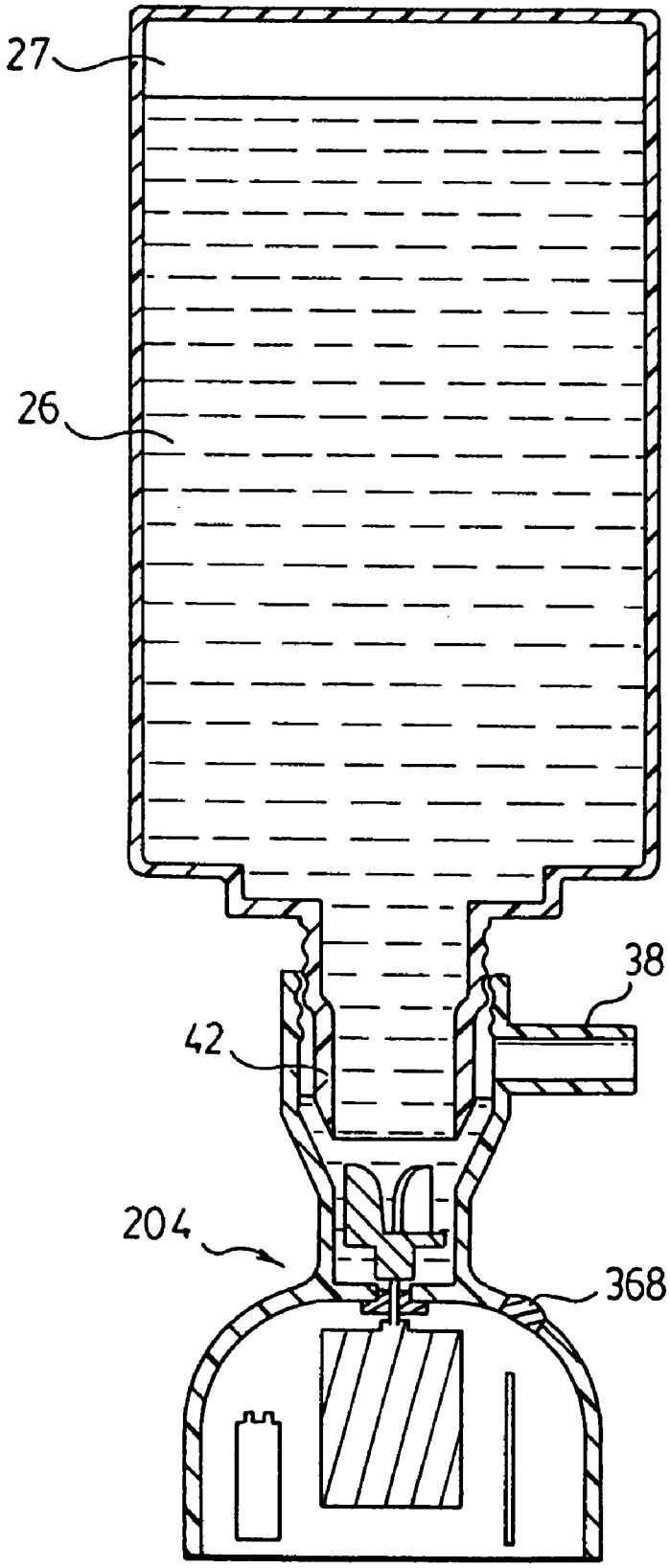
FIG. 28 is a view the same as that in FIG. 6 but showing the entire dispenser.

FIGS. 27 and 28 illustrate an assembled open position after fluid has been dispensed and the system has been left to assume its own equilibrium. The lower portion of the bottle is filled with liquid 26 with an upper portion of the bottle including air 27. Liquid in the chamber 33 is at a height above the liquid inlet 44 but below the air inlet 40 and air tube 38. Because the height of the fluid in the chamber 33 is below the inlet tube 38, fluid does not flow out from the chamber 33. Fluid does not flow out of the bottle 202 down into the chamber 33 as a result of vacuum which is developed within the bottle 202.

The configuration of the cap 204 and neck of the bottle shown in FIG. 27 acts as a vacuum relief device in that insofar if a sufficient vacuum is developed within the bottle 202, then the inherent resiliency of the bottle will draw liquid from the chamber 33 upwardly into the bottle 202 until the level of liquid within the chamber 33 reaches or passes below the level of the liquid inlet 44. At this point, air in the chamber 33 will enter into the bottle and pass upwardly into the bottle. Once sufficient air has entered into the bottle, the vacuum within the bottle 202 becomes relieved sufficiently that the level of fluid within the chamber 33 will be equal to or above the liquid inlet 44 at which point no further air may then enter the bottle 202 to further relieve the vacuum in the bottle.

The vacuum in the bottle may be created by drawing liquid from the bottle by operation of the impeller or by compressing the bottle to reduce its volume and then releasing the bottle.

As seen in FIG. 27, the liquid tube 42 is coaxial within the cap 204 and an annular passageway 41 is defined between the side wall 36 and the liquid tube 42. As seen in FIG. 27, the chamber 33 includes this annular passageway 41 between the side wall 36 and the liquid tube 44. The air inlet 40 and the air tube 38 open into this passageway 41. As seen in FIG. 26, in an assembled closed position, the annular passageway 41 is closed at its lower end to the remainder of the chamber 33 by reason of the engagement between the liquid tube 42 and the side wall 36. In contrast as seen in FIG. 27, there is an annular opening to the passageway 41 formed as an annular gap between the end of the liquid tube 42 and the side wall 36.

In the open position as seen in FIG. 27, liquid may be dispensed from the bottle 202 in two manners.

Firstly, liquid may be dispensed from the bottle 202 by compressing the bottle 202 so as to reduce its volume. Thus, a user may manually compress the bottle 202 as by grasping the bottle and urging opposite sides of the bottle together. This compression attempts to reduce the volume of the bottle, applying pressure to the contents in the bottle and thus forcing liquid out of the liquid tube 42 into the chamber 33 increasing the level of liquid in the chamber 33 to an extent that the level of liquid reaches the height of the air tube 38 and liquid flows and/or is forced out of the air tube 38 to atmosphere. On release of the compressive forces on the bottle, the bottle will under its inherent bias attempt to assume its inherent shape and thus will, due to the vacuum in the bottle, draw liquid and/or air in communication with the liquid inlet 44 back upwardly into the bottle. In this manner, liquid in the chamber 33 will be drawn back into the bottle until the level of liquid in the chamber 33 becomes below that of the liquid inlet 44 and air may be drawn back into the bottle 202 to an extent to at least partially relieve the vacuum in the bottle 202.

Rotation of the impeller 250 is the second manner to dispense liquid from the container 33. On activation of the motor 356, the impeller 250 is rotated about the vertical axis 210. The impeller 250 is shown as having a circular disc 251 disposed normal the axis and three axially and radially extending circumferentially spaced vanes 249. Rotation of the impeller 250 directs fluid radially outwardly from the center of the impeller. Particularly, with the impeller 250 shown, fluid which is above the impeller as from the liquid inlet 44 is directed by the impeller to be urged radially outwardly and, hence, through the gap between liquid tube 42 and side wall 36 and into the annular passageway 41. Fluid is urged radially into the passageway 41 to an extent that the level of the fluid in the passageway 41 rises above the height of the air tube 38 and thus liquid exits from the chamber 33 via the air tube 38. Rotation of the impeller 250 may tend to create a standing wave or vortex. The rotation of the impeller 250 thus draws fluid downwardly from the bottle 202 and pumps it as in the manner of a circumferential pump via the annular passageway 41 upwardly to exit from the air inlet 40. By so drawing fluid from the bottle 202, an increased vacuum condition is created in the bottle 202. When the motor is deactivated and the impeller 250 stops to rotate, the increased vacuum condition exists in the bottle 202 and thus the inherent tendency of the bottle to assume its inherent shape will draw liquid and/or air in the chamber 33 back into the bottle 202 to relieve vacuum in the bottle in the same manner as described earlier. The configuration of the impeller 250 does not impede the flow of liquid and/or air between the liquid inlet 44 and the air inlet 40 for passage of liquid out of the bottle or the passage of liquid and/or air into the bottle.

It follows, therefore, that the liquid dispenser as shown in the ninth embodiment is adapted for dispensing fluid either manually by compressing the bottle or automatically by motor operation of the pump.

In the case that the motor is inoperative, the dispenser may therefore be used manually without modification.

Reference is made to FIGS. 26 and 27 which schematically show a mechanism for operation of the motor 356. Schematically shown are a battery 364, a control circuit board 366 and a switch 368. Wiring to connect these components is not shown. The switch 368 illustrated preferably comprises an infrared transmitter and receiver which will emit light and sense such light as reflected from a user's hand placed underneath the air tube 38. Under such conditions, the control circuit board 366 will operate the impeller 250 for a desired period of time as may be selected to dispense an appropriate allotment of liquid. The operation of the sensor switch and motor may be controlled by a simple control circuit as in a known manner.

The particular nature of the switch 368 may vary and the switch could alternatively comprise a simple on/off switch manually to be activated by a first hand of a user while a second hand of the user is placed underneath the air tube 38.

While a battery 364 is shown, the motor could, of course, be operated by a remote electrical power source.

The motor 356 is preferably an inexpensive, wound electrical DC motor which operates at relatively high rotational speed and will have minimal power requirements. The impeller 250 is preferably selected having regard to the nature of the motor and the viscosity of the fluid to provide for relatively high speed rotation of the impeller by the motor with minimal power draw. The relative configuration of the cap 204 and the neck 208 of the bottle is preferably selected having regard to the impeller, motor and power available to the motor to minimize the height to which the impeller must force the fluid up into the passageway 41 in order to dispense liquid.

Preferred, inexpensive electric motors are those which have power ratings in the range of 1.0 to 0.2 watts. For example, one preferred motor is available under the trade name Mabuchi as model number RE-260 RA-18130 which draws about 0.1 amps at 3 volts DC when unloaded or about 0.05 amps at 6 volts DC.

To the extent it is desired to minimize power consumption, then the relative size of each of the impeller vanes 249 may be minimized to permit with reduction of the impeller blade size increased speed of rotation of the impeller other considerations remaining the same.

The particular configuration of the impeller may vary to a wide extent. For example, the impeller may have a second circular upper plate parallel to the lower plate 251 and spaced therefrom with the vanes 249 in between and a central opening through the upper plate to permit fluid flow centrally between the plates and, hence, radially outwardly as directed by the vanes. The simplified impeller as illustrated is believed preferable so as to permit generation of a swirling vortex as below the liquid tube 42 centrally thereof which is believed to enhance the flow of fluid radially and upwardly via the annular passageway 41. The height of the vortex can be varied by changing the speed of rotation of the impeller with increased speed generally increasing the height of the vortex.

In the preferred embodiment, the container 202 is illustrated as being open only at its liquid inlet 44. Preferably, the liquid dispenser comprising both the cap 34 and the bottle 202 may be transported and stored before use in a position with the neck of the bottle up and may be inverted to the position shown in FIG. 26 only prior to initial use.

The dispenser in accordance with the present invention is particularly adapted for dispensing liquid such as liquid soap and other cleaners. The dispenser is particularly advantageous for liquids which do not have a high viscosity and is found to be useful with typical liquid soaps commercially available.

The dispenser has also been found to be particularly advantageous for dispensing liquids which have viscosities roughly approximately to that of water and liquids such as alcohol based disinfectants as used in hospitals which have viscosities less than that of water.

In that of normal operation of the liquid dispenser of the ninth embodiment, the vacuum in the bottle 202 draws liquid back from the air tube 38 into the chamber 33, the system thus inherently prevents dripping of liquid from the air tube 38.

The preferred embodiment illustrated shows the liquid tube 42 as being cylindrical and as having a radius substantially equal to the radius of the side wall 36 over the lower cylindrical portion 228. The impeller 250 is shown as being sized to have a radial extent marginally less than the radius of the side wall 36 in the lower portion 228. The preferred embodiment shows the side wall 36 as including the frustoconical portion 229 which opens upwardly from the cylindrical lower portion. Many modifications and variations will occur to persons skilled in the art. For example, the impeller may be provided in a lower portion of the cap 204 which has a radius which is greater than a radius of the liquid tube 42 with the impeller having a radius less than, equal to or greater than the radius of the liquid tube 42, however, is believed to be preferred if the radius of the impeller is only marginally smaller than the radius of the side wall 36 radially outwardly from the impeller.

In the preferred embodiment, given that the energy consumption of the motor is preferably selected to be low, a system comprising in combination a rechargeable battery and a small solar panel carried on the cap may well comprise an advantageous configuration.

In accordance with the preferred embodiment, the cross-sectional area of the passageway 41 which is open to the radial discharge from the impeller 250 is relatively large. This is advantageous such that only a minimal increase in pressure is required in order to raise the level of fluid in the chamber 33 to a point that the level of fluid is above the air tube 38 and fluid may thus be dispensed.

Figure 29:
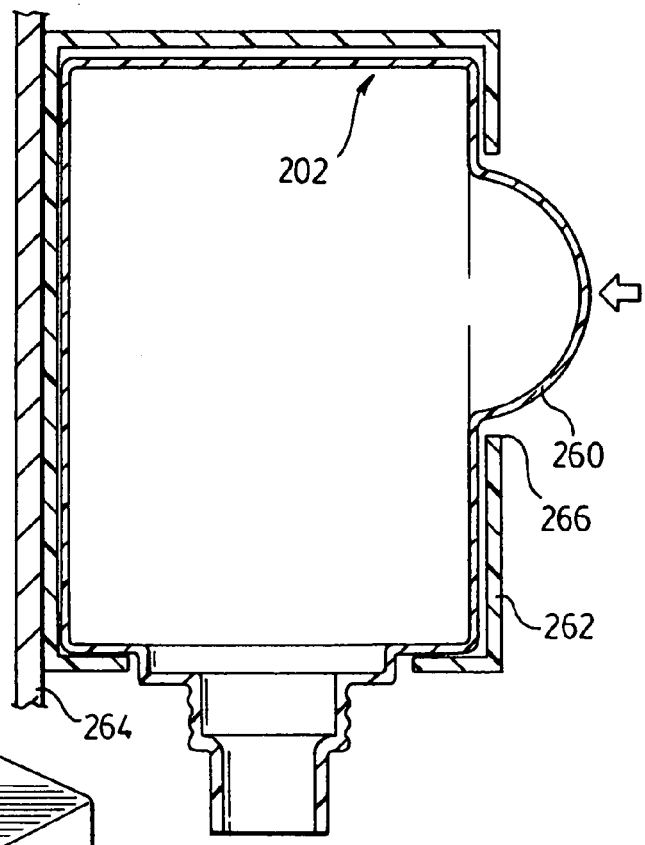
FIG. 29 is a cross-sectional side view of a modified bottle for use with a dispenser similar to the ninth embodiment.

Reference is made to FIG. 29 which illustrates a modified bottle 202 for use with an arrangement similar to that shown in FIGS. 22 to 28. The modified bottle 202 carries a semi-spherical bulbous protrusion 260 on one side of the bottle 202 which is adapted for manual engagement to compress the bottle and dispense fluid. The bottle 202 is illustrated in combination with a hard shroud 262 to cover the bottle which shroud could, for example, form part of a housing as to secure the dispenser to a wall 264. Preferably, the bulbous protrusion 260 on the bottle 202 may extend out through an opening 266 in the shroud 262. The protrusion effectively serves as an enlarged push surface which a user could engage with his hand and urge into the wall supporting the housing, thus, effectively manually compress the bottle and dispense fluid.

Figure 30:
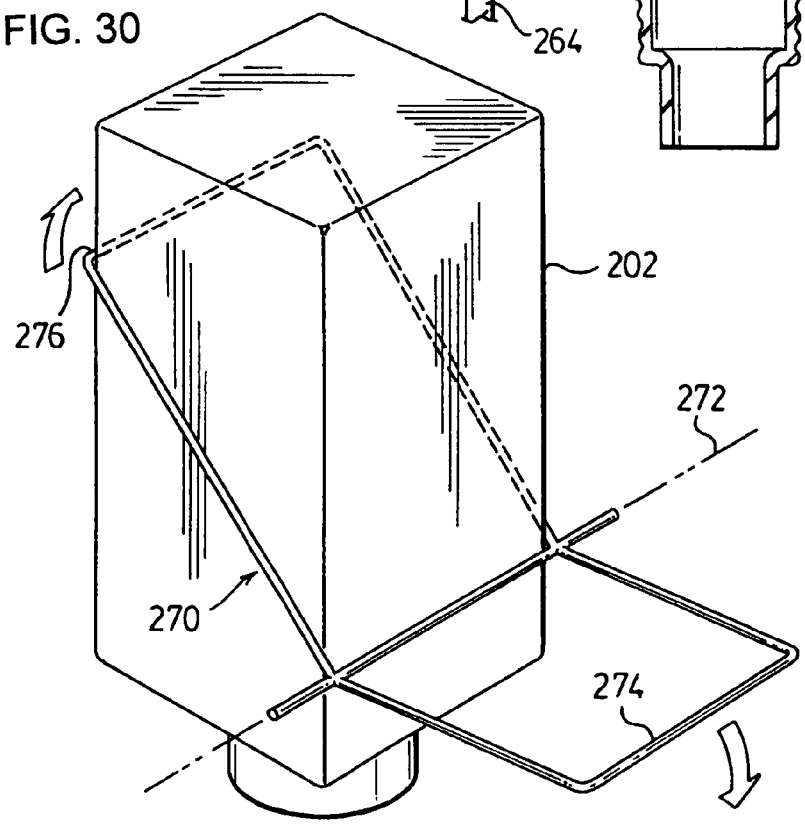
FIG. 30 is a schematic pictorial view of a manually operated lever mechanism to compress a bottle similar to that in the ninth embodiment.

Reference is made to FIG. 30 which shows another mechanism to manually compress the bottle. A lever 270 is mounted for pivoting about axis 272 to a housing (not shown) and includes one end 274 of the lever which is adapted for manual engagement by a user and another end 276 of the lever which would then be urged into the compressible bottle 202 to compress the same. Such an arrangement is, in the simple sense, illustrated in FIG. 30.

Figure 31:
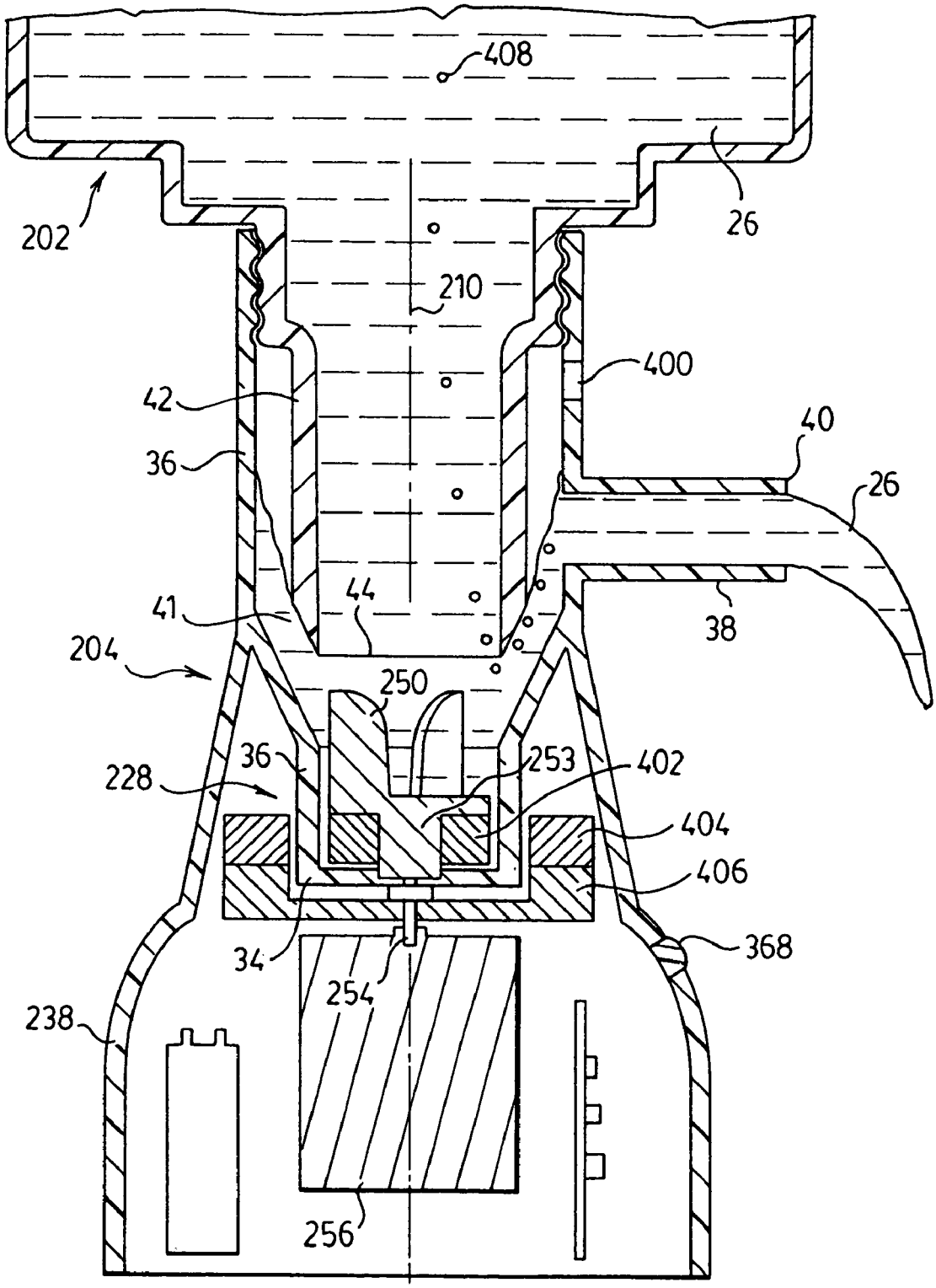
FIG. 31 is a cross-sectional view similar to FIG. 27 but of a dispenser in accordance with a tenth embodiment of the invention.

Reference is made to FIG. 31 which shows a cross-sectional view similar to FIG. 27 but of a tenth embodiment of the present invention.

The embodiment in FIG. 31 is modified in two respects over that of FIG. 27.

Firstly, in addition to the air tube 38 and the air inlet 40, a secondary air inlet is provided as an opening 400 through the side wall 36 of the cap 204 at a height above the air tube 38.

As a second modification over that shown in FIG. 26, the impeller 250 in FIG. 31 is rotated by a magnetically coupled drive mechanism. Magnetically coupled drive mechanisms are known. A suitable drive is taught, for example, by U.S. Pat. No. 3,306,221 to Goodpasture issued Feb. 28, 1967. As seen in FIG. 31, the side wall 36 extends downwardly to form with the base 34 an enclosed cylindrical lower portion 228 within which the impeller 250 is rotatable journalled coaxially about the axis 210 by reason of a stub axle 253 extending downwardly and being received in a journaling blind bore in the base 34. Secured about the stub axle 253 is a driven magnet 402.

Coaxially about the lower cylindrical portion 228 is an annular driver magnet 404 carried on a cylindrical cup-shaped carrier 406 which is journalled for rotation about the axis 210 and rotated by being coupled via the shaft 254 to the motor 256. In a known manner, rotation of the driver magnet 404 by the motor 256 causes the driven magnet 402 and therefore the impeller 250 to rotate. Such magnetically coupled motors are commercially available and have the advantage that no seal is required between the impeller and the motor.

Operation of the embodiment in FIG. 31 is identical to that described with the ninth embodiment, that is, when the impeller is not rotating, the liquid 26 establishes a level which is intermediate the air inlet 40 and the liquid inlet 44 as maintained by the at least partial vacuum within the bottle 202. On rotation of the impeller 250, liquid is pumped axially through the passageway 41 and out of the air tube 38. The air opening 400 is provided so as to facilitate continuous dispensing of fluid.

With many soap dispensers, it is desired to merely dispense individual dosages of liquid with each operation of the pump. This can be accomplished in many manners such as by controlling the time of operation of the pump and the like. In accordance with the ninth embodiment as illustrated in FIG. 27, the dispenser can be arranged such that on rotation of the impeller 250, on dispensing of the liquid from the air tube 38, a vacuum becomes developed in the bottle 202 to an extent that the pump is not capable of pumping an additional amount of liquid out of the air tube. Thus, while the impeller 250 may continue to rotate and create a vortex within the cap, the vacuum created in the bottle 202 will prevent dispensing an additional amount of liquid.

This can be an advantageous manner of operating the pump of FIG. 27 such that inherently due to the vacuum created within the bottle 202, on operation of the motor and even with continued operation of the motor only, a predetermined dosage of liquid may be able to be dispensed given that after dispensing a certain amount of liquid, a vacuum is created in the bottle which prevents further liquid from being dispensed. Thus, even if the impeller may be rotated for some additional time, merely a single dosage of liquid will be dispensed. To dispense a second dosage requires stopping rotation of the impeller which will then let the liquid in the passageway 41 be drawn back under the vacuum in the bottle such that air may come to be below the liquid inlet 44 and, hence, relieve the vacuum in the bottle.

In accordance with the embodiment illustrated in FIG. 31, the secondary air inlet provided by air opening 400 can be of assistance in permitting continuous dispensing of liquid from the container. In the embodiment of FIG. 31, with the rotation of the impeller and on liquid passing out through the air tube 38 and substantially filling the air tube 38 as shown, the secondary air inlet provided by the opening 400 can permit air to enter into the passageway 41. A significant vortex which can be set up in the passageway 41 tends to urge liquid against the outer wall 36 of the cap and assists in permitting air to extend radially inwardly adjacent the liquid tube 44 and move downwardly to the liquid inlet 44 and, hence, pass upwardly into the bottle 202 to relieve the vacuum therein and thus permit continuous pumping. FIG. 31 illustrates a condition in which the impeller 250 is rotated at high speed and a vortex has been set up not only internally within the liquid tube 42 but also within the passageway 41 where the vortex has an air liquid interface.

In FIG. 31, air is shown to conceptually pass downwardly in the vortex and hence up the liquid tube 42 as illustrated by bubbles 408.

Figure 32:
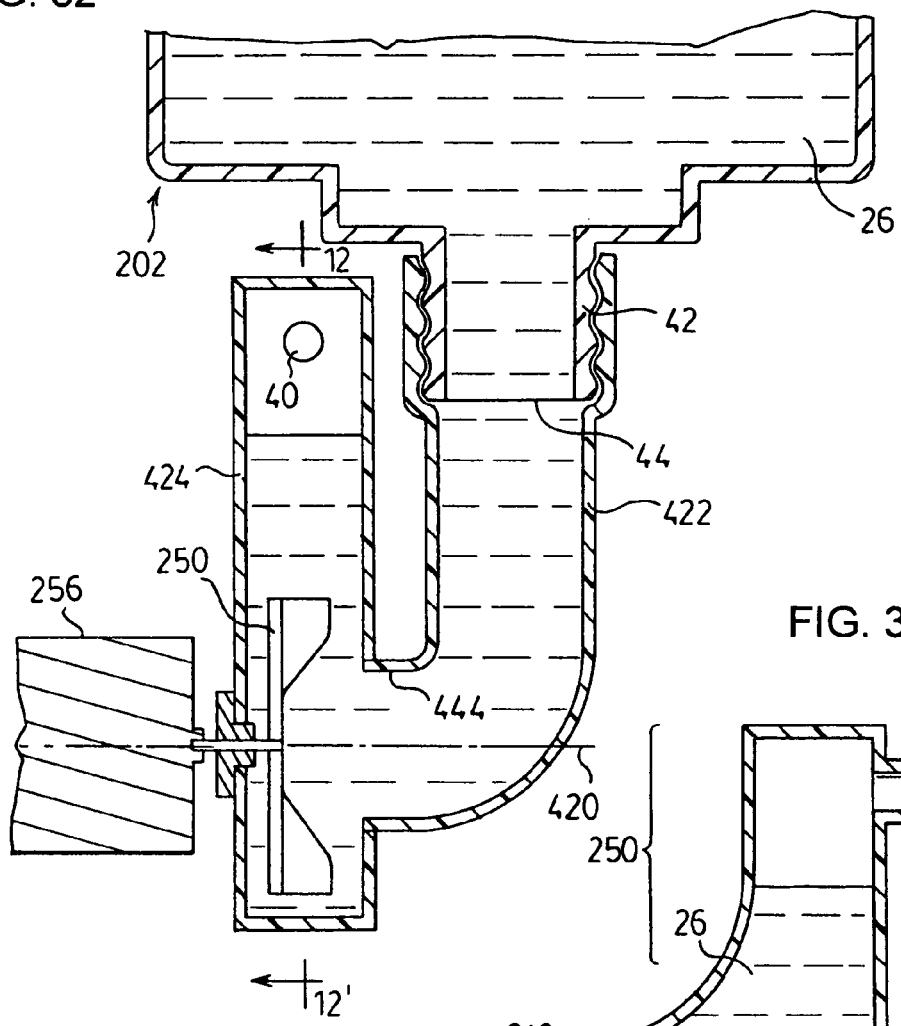
FIG. 32 is a vertical rear cross-sectional view of a dispenser in accordance with an eleventh embodiment of this invention.
Figure 33:
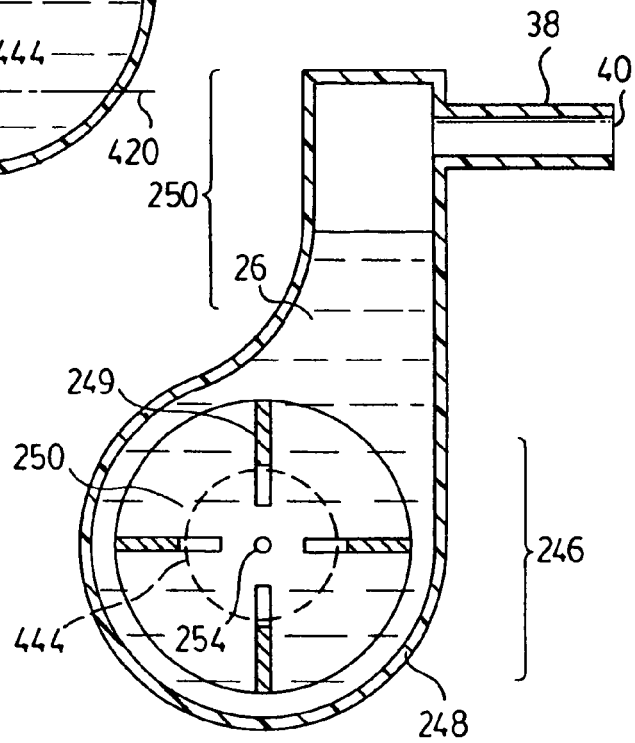
FIG. 33 is a cross-sectional view along section line 12–12' in FIG. 11.

Reference is made to FIGS. 32 and 33 which show an eleventh embodiment of the invention in accordance with the present invention and in which similar reference numerals are used to refer to similar elements. The embodiment of FIGS. 32 and 33 illustrates a configuration in which the impeller 250 is disposed for rotation about a horizontal axis 420. As seen in FIG. 32, the bottle 202 is threadably connected to a right angled feed tube 422 which directs fluid 26 from the bottle 202 into a pump housing 424 which has a lower portion 246 with a generally cylindrical side wall 248 and which merges upwardly into an upper portion 250 from which the air inlet tube 38 extends outwardly to the air outlet 40. The feed tube 422 effectively extends the liquid tube 42 on the bottle and provides an effective liquid inlet 444 which, as best seen in FIG. 32, is disposed below the air inlet 40. The liquid inlet 444 is illustrated as to its location in dotted lines in FIG. 33 and provides an inlet to the centre of the impeller 250. With rotation of the impeller 250, the vanes on the impeller direct liquid circumferentially outwardly and, thus, act in the manner as a centrifugal pump to pump fluid from the liquid tube 42 upwardly to raise the liquid in the housing 424 to a height that the liquid can flow out the air tube 38.

Use of an impeller such as that shown in FIG. 32 advantageously permits air and liquid to flow between the bottle 202 and the air tube 38 when the impeller is not rotating as is advantageous for manual dispensing of liquid as by compressing the bottle 202, and, for vacuum relief by passage of air from the air tube 38 back into the bottle 202.

While the preferred embodiments show impellers disposed for rotation about a vertical or a horizontal axis, it is to be appreciated that the impellers may be adapted for rotation about an axis disposed at almost any angle as may be convenient.

Figure 34:
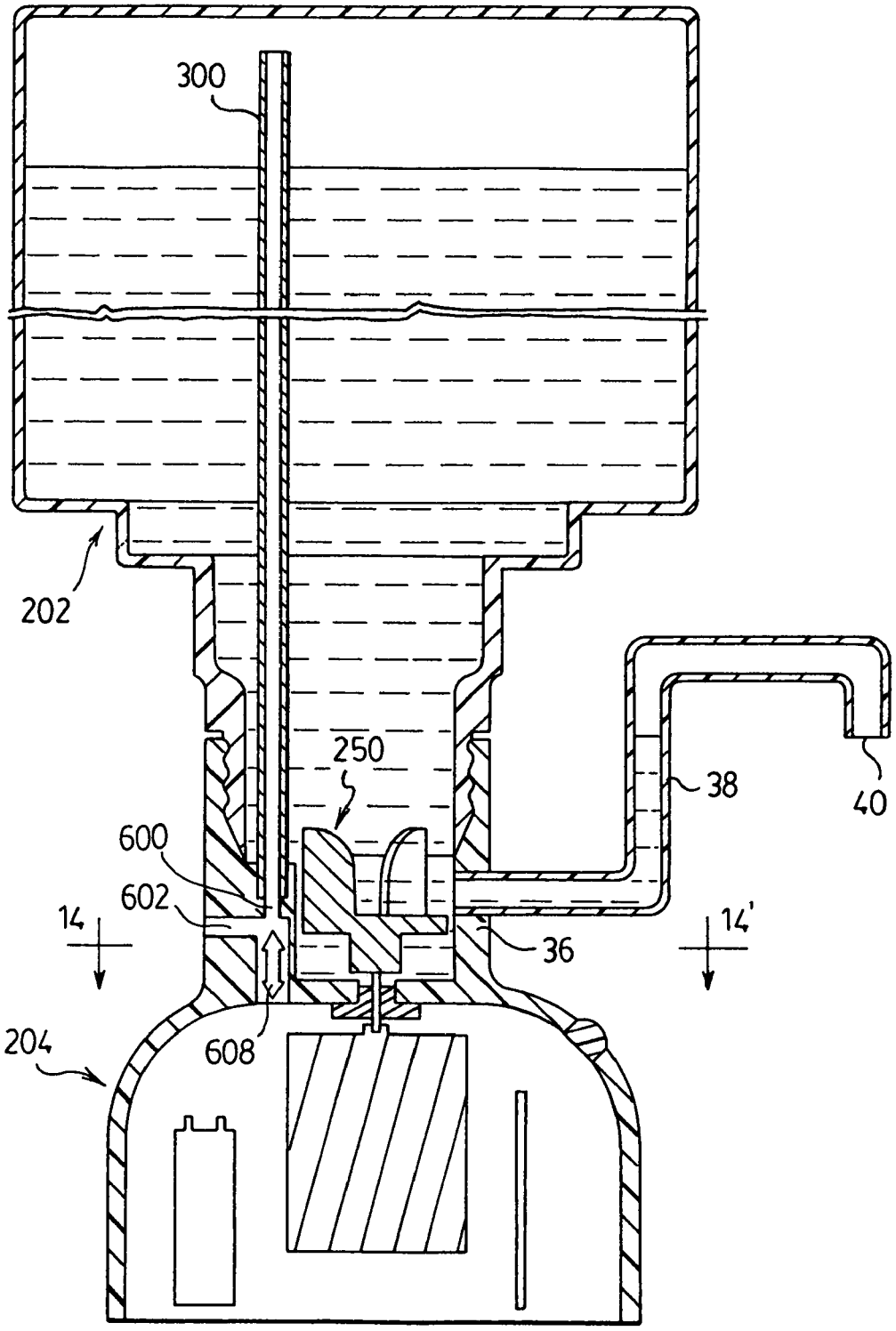
FIG. 34 is a cross-sectional view similar to FIG. 6 but of a dispenser in accordance with an eleventh embodiment of this invention.

Reference is made to a twelfth embodiment of a dispenser in accordance with the present invention as illustrated in FIGS. 34 and 35.

This embodiment has many similarities to the ninth embodiment, however, notable differences are that the bottle 202 is a rigid substantially non-compressible bottle.

The cap 204 and neck of the bottle 208 are modified so as to not form a vacuum release device as with the ninth embodiment. In this regard, the outlet tube 38 in FIG. 10 exits from the side wall 36 of the cap at a lowermost portion of the cap. No air is intended to be in the system other than at the upper end of the bottle. A vacuum relief tube 300 is provided which extends to one side of the impeller 250 vertically upwardly into the bottle 202 to the upper end of the tube. The air inlet tube 300 has its lower end engaged in a passageway 600 which passes downwardly through the cap and is joined by a radical passageway 602. A valve 608 only schematically illustrated is disposed in the passageway 600 tube within the cap biased to a closed position and arranged to be opened electrically as in the manner of a simple solenoid valve.

The outlet tube 38 extends upwardly and then downwardly to an exit opening 40. With operation of the impeller 250 by the motor, with the solenoid valve 608 open, relatively low pressure is required to be generated by the impeller 250 to pump fluid out the inlet tube 38. When the impeller is stopped from rotating, the solenoid valve 608 closes and the up and down path of the outlet tube 38 will prevent any substantial dripping of liquid from the outlet 40 since the bottle 202 is non-compressible and the valve 608 closes the air relief tube 300. The impeller and its motor provide a convenient, inexpensive centrifugal pump arrangement for dispensing fluid with vacuum relief to the bottle being provided via the vacuum relief tube 300 and its solenoid valve 602.

The solenoid valve is biased to a closed position and may be opened during at least part of the time when the impeller is rotated thus facilitating flow of liquid from the bottle due to gravity and assisted by rotation of the impeller. The valve can be controlled by the control circuit for closing of the valve in a time cycle relative the activation and deactivation of the motor, possibly more preferably with the impeller to continue rotating for sometime after the valve is closed to assist in creating at least a partial vacuum within the bottle.

Reference is now made to FIGS. 36 to 42, each of which includes a reservoir 500, a pressure relief device 502 and a pump 504. In each case, a liquid tube 42 exits from the reservoir and is disposed with its liquid inlet within the pressure relief device 502 at a height below an air tube 38 and its air outlet with a level of liquid in the pressure relief device 502 being intermediate the liquid inlet and the air inlet.

FIG. 36 illustrates a condition in which the pump 504 is connected to the reservoir. On operation of the pump to dispense fluid from the reservoir 500, a vacuum may be developed in the reservoir 500 to an extent as permitted by the vacuum relief device 502 which, at some point, will permit air to be drawn up the liquid tube 42 to relieve the pressure in the reservoir 500. FIG. 36 permits continuous dispensing.

FIG. 37 illustrates a condition in which the pump 504 is connected to a lower liquid sump portion of the pressure relief device 502 below the level of the liquid. On activation of the pump, liquid is drawn from the reservoir 500 into the sump of the pressure relief device 502 and air may enter the air tube 38 to relieve vacuum developed in the reservoir 500.

FIG. 38 illustrates an arrangement in which the pump 504 is disposed within the sump of the pressure relief device 502 and the pump receives fluid from the liquid tube 42 connected to the reservoir. The pump discharges liquid into the pressure relief device. Liquid is discharged from the air tube 38 and the arrangement is adapted for both air and liquid flow through the tube 38 and, as well, air and liquid flow through the pump 504.

Figure 39:
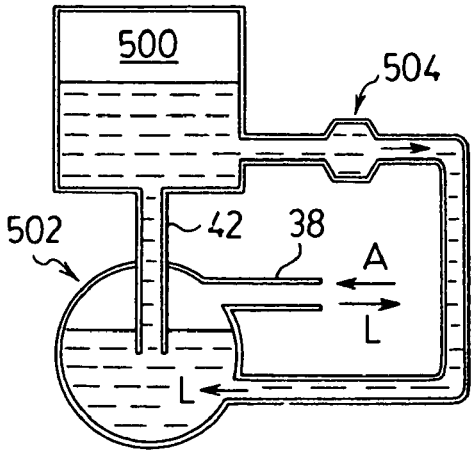

FIG. 39 illustrates an arrangement similar to FIG. 36, however, in which the pump 504 discharges to the sump of the pressure relief device 502.

Figure 40:
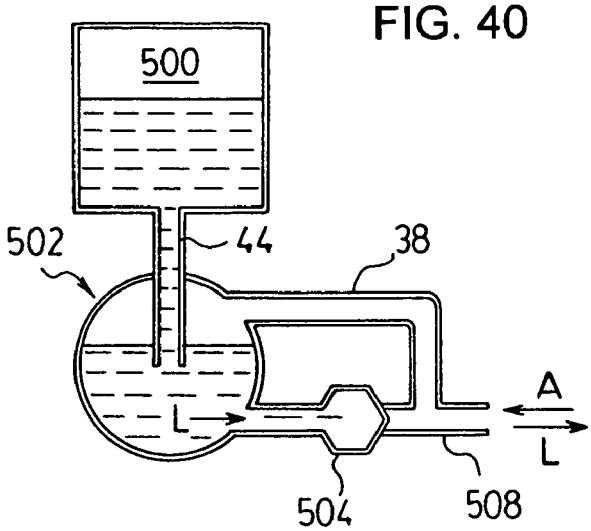

FIG. 40 illustrates a condition similar to FIG. 37, however, in which the air tube 38 is joined to a liquid outlet 508 from the pump 504.

Figure 41:
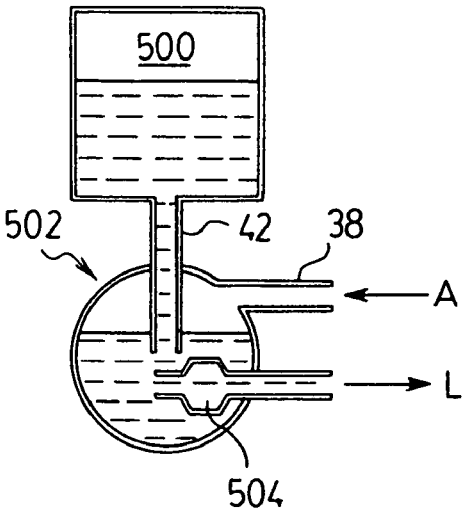

FIG. 41 illustrates an arrangement similar to FIG. 37, however, in which the pump 504 is internal within the sump of the pressure relief device 502.

Figure 42:
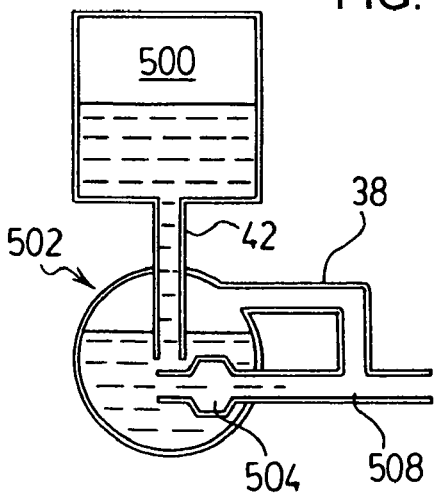
Figure 43:
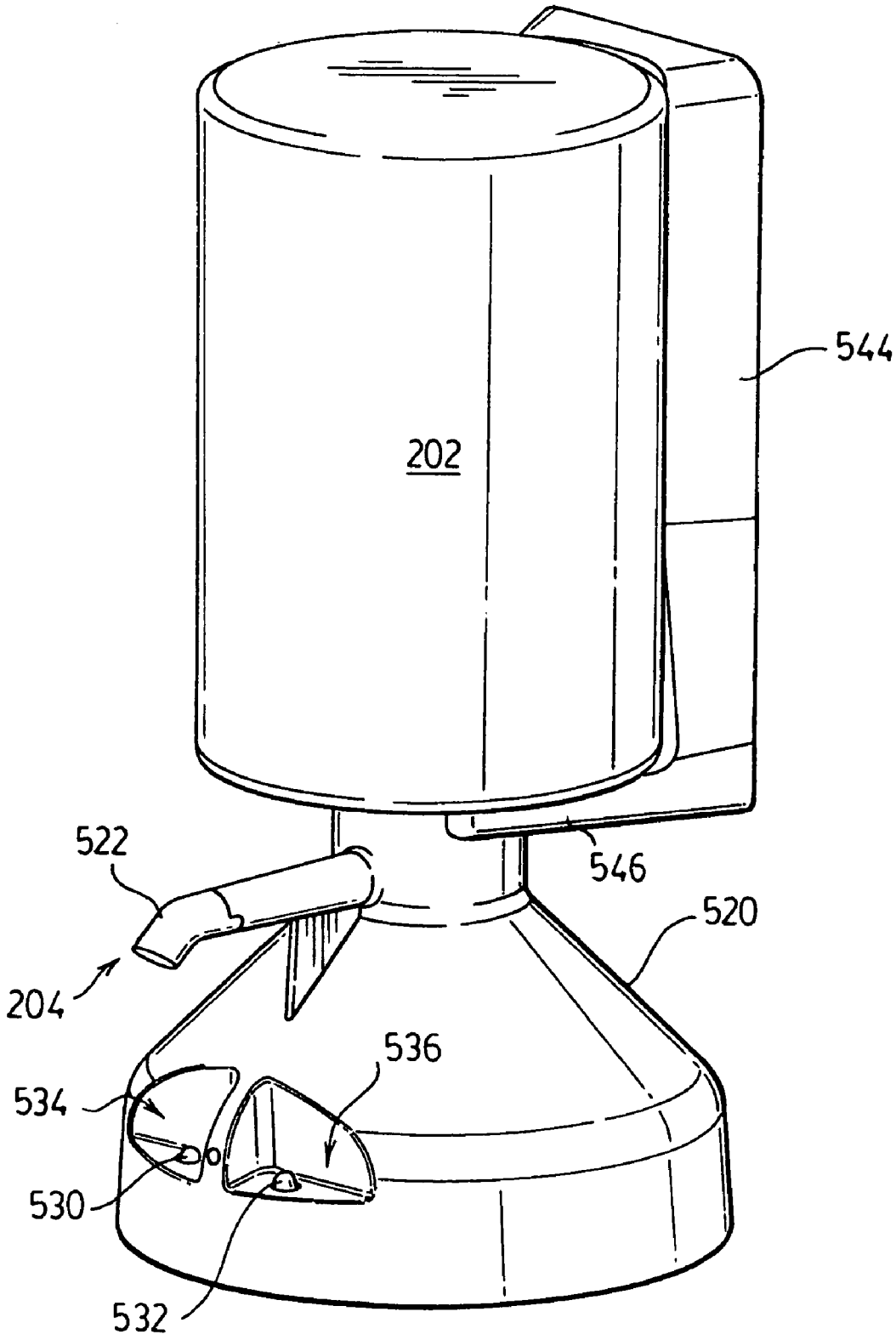
FIG. 43 is pictorial view of a dispenser in accordance with a twelfth embodiment of the present invention.
Figure 44:
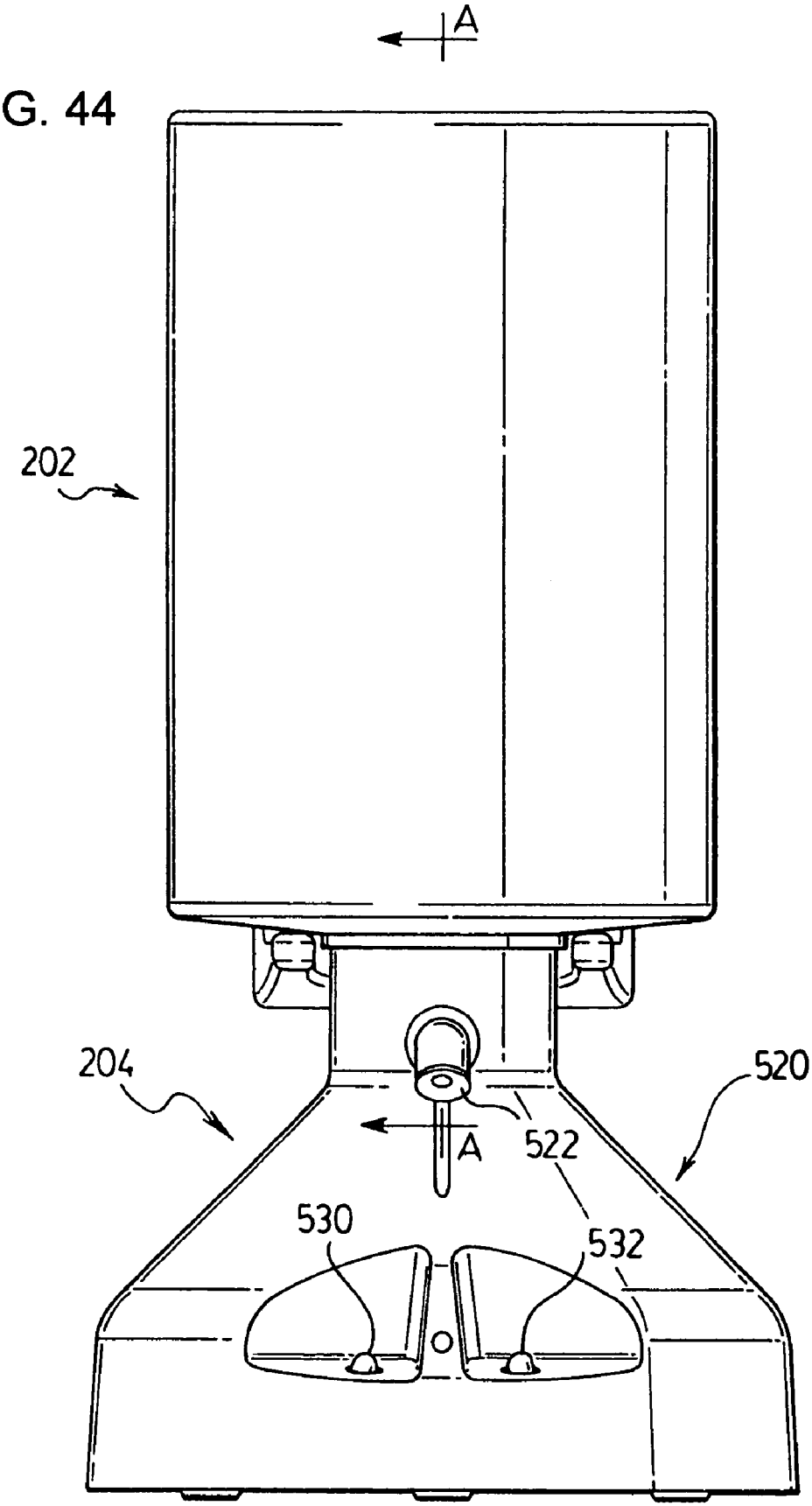
FIG. 44 is a front view of the dispenser of FIG. 43.

FIG. 42 illustrates a condition similar to FIG. 41, however, in which the air tube 38 is connected to the outlet 508 from the pump 504.

The embodiment illustrated in FIGS. 22 to 28 is schematically shown in FIG. 38 in which embodiment both the air and liquid must pass inwardly and outwardly through the pump 504, as well as through the air tube 38 and the liquid tube 42. Such arrangements require a pump which permits flow inwardly and outwardly such that the arrangement can permit air to enter the reservoir 500 to relieve vacuum in the reservoir. As well, such a configuration permits dispensing by manually compressing the reservoir.

In the arrangement of FIG. 36, the pump 504 preferably merely permits flow outwardly. The arrangement of FIG. 36 nevertheless will permit manual operation when the pump is not operative by compressing the reservoir 500. Similarly in FIG. 37, the pump 504 is intended to merely permit fluid flow outwardly. The arrangement of FIG. 37 will also permit manual dispensing by compressing of a compressible container 500.

In the arrangement of FIG. 39, the pump 504 preferably merely permits fluid flow in one direction, however, may permit fluid and/or air flow in both directions therethrough. In either event, the arrangement of FIG. 39 is adapted for manual dispensing by compressing the container 500. In FIG. 39, whether operated by the pump or manual compression, both air and liquid will pass out through the air tube 38, however, it is not necessary that the pump 504 permits fluid flow other than outwardly from the reservoir 500.

The arrangement of FIG. 41 is substantially of the same effect as that in FIG. 37 with the pump 504 to merely permit liquid flow outwardly. The difference between FIG. 41 and FIG. 37 is that in FIG. 41, the pump is shown as being located internally within the sump of the liquid control device which may be convenient.

FIG. 42 is an arrangement substantially the same as that shown in FIG. 41, however, with the air tube 38 connected to the pump discharge tube 508 and in the embodiment of FIG. 42, it is preferred that the pump merely permit liquid flow outwardly.

In each of the embodiments of FIGS. 36 to 42, the container preferably is a collapsible container with an inherent bias to assume an inherent shape. The flow of air or liquid from the various openings is indicated for air by the letter "A" or for liquid by the letter "L".

Reference is made to FIGS. 43 to 47 which shows a twelfth embodiment of a dispenser in accordance with the present invention which is similar in its operation to the dispenser of FIGS. 22 to 28. The same reference numbers are used in FIGS. 46 to 48 as in FIGS. 22 to 28 to show similar elements.

A base-cap 204 comprises a body portion 520, a nozzle 522 and a closure plate 524, each of which is preferably an integral element injection molded from plastic.

An electric unit 526 is provided, preferably as a pre-assembled unit which is incorporated therein, a motor 256, a motor shaft 254, a battery 364, a control circuit board 366 and two switch devices 368 and 369. Each switch device preferably comprising both a transmitter and a receiver to respectively emit radiation and sense reflected radiation. The electric unit 526 is adapted to be inserted vertically into a hollow interior 528 of the base-cap 204 with a seal member 253 forming a seal about the motor shaft 254 and between a shaft opening 263 of the base-cap 204 comprising an opening for the shaft 254 and an upper most end of the motor comprising portion 256 of the electric unit 526.

The electric unit 526 is secured in place in the base-cap 204 by a closure plate 524, sandwiching the electric unit 526 between the base-cap 202 and the closure plate 524.

When in place in the base-cap 202, the electric unit 526 presents its two switch devices 368 and 369 to extend in sealed relation through two switch openings 530 and 532 provided in recesses 534 and 536 in a front surface of the base-cap 202 underneath the nozzle 522.

Providing the electric unit 526 to incorporate one or more, but preferably a single circuit board 366 to carry all control elements, the sensors and electrical connections for the motor and batteries, or connections to external power, is advantageous to reduce cost.

Figure 45:
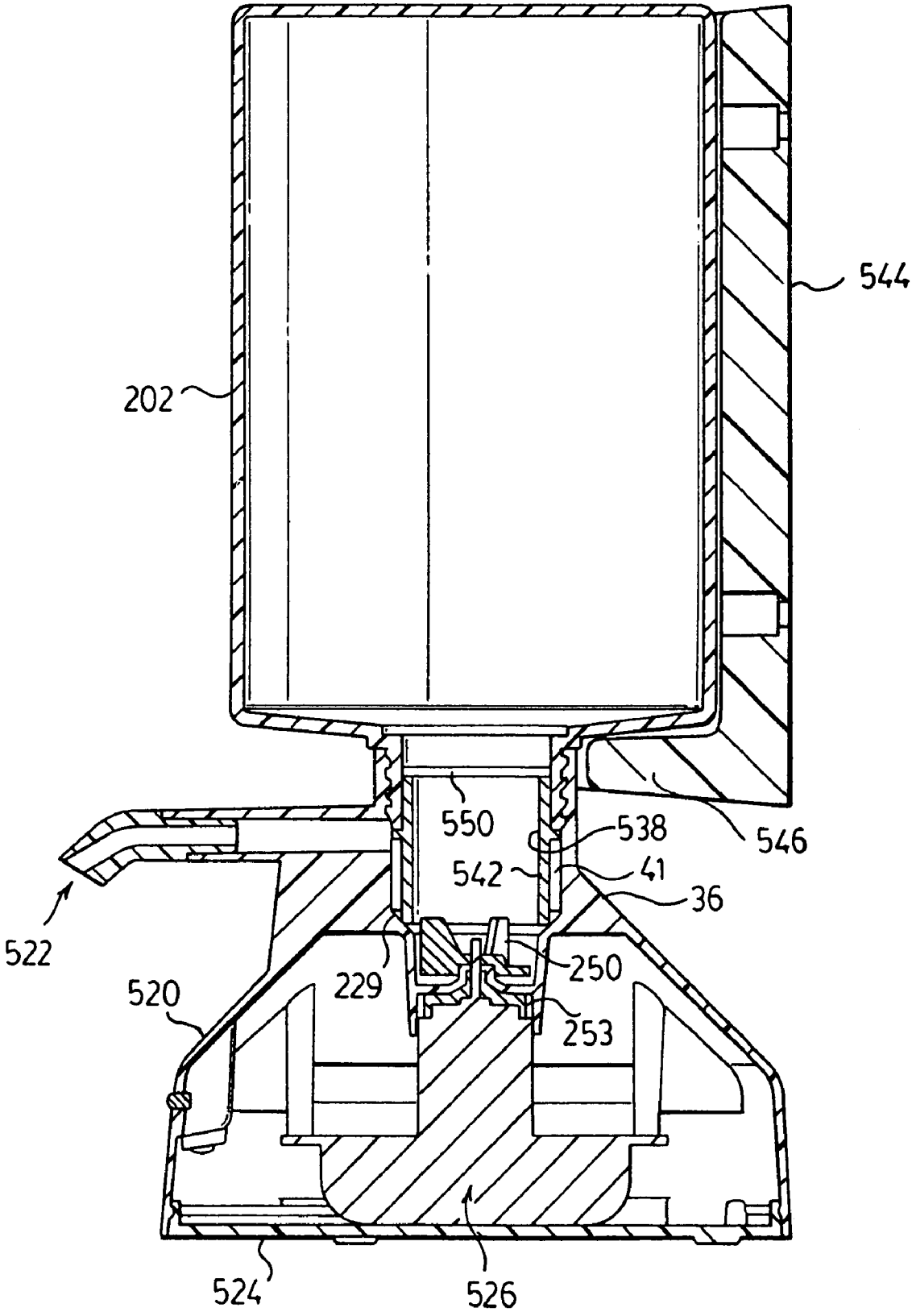
FIG. 45 is a cross-sectional view of the dispenser of FIG. 44 along section line A–A'.
Figure 46:
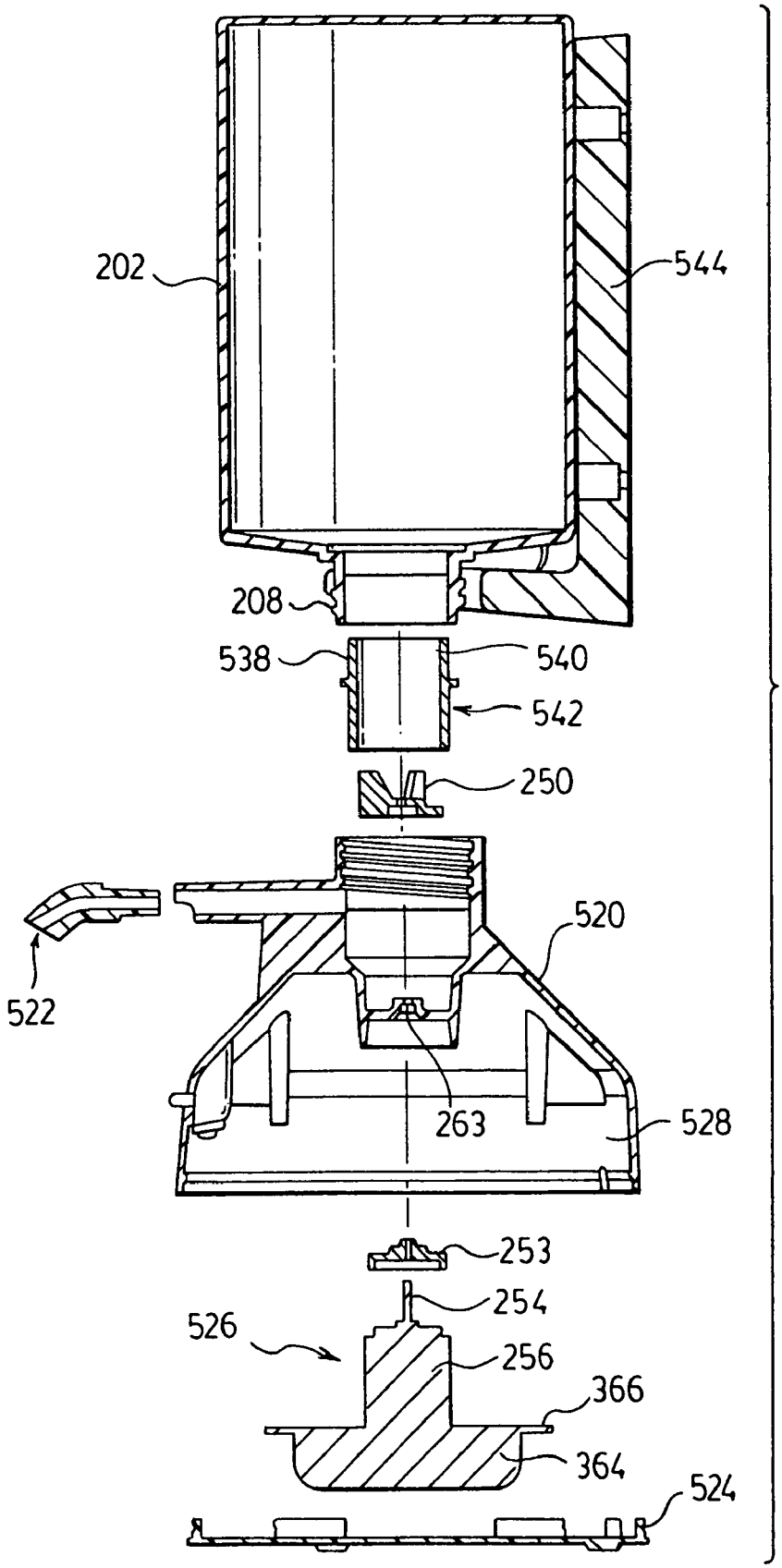
FIG. 46 is a schematic exploded pictorial view of the dispenser of FIG. 43.
Figure 47:
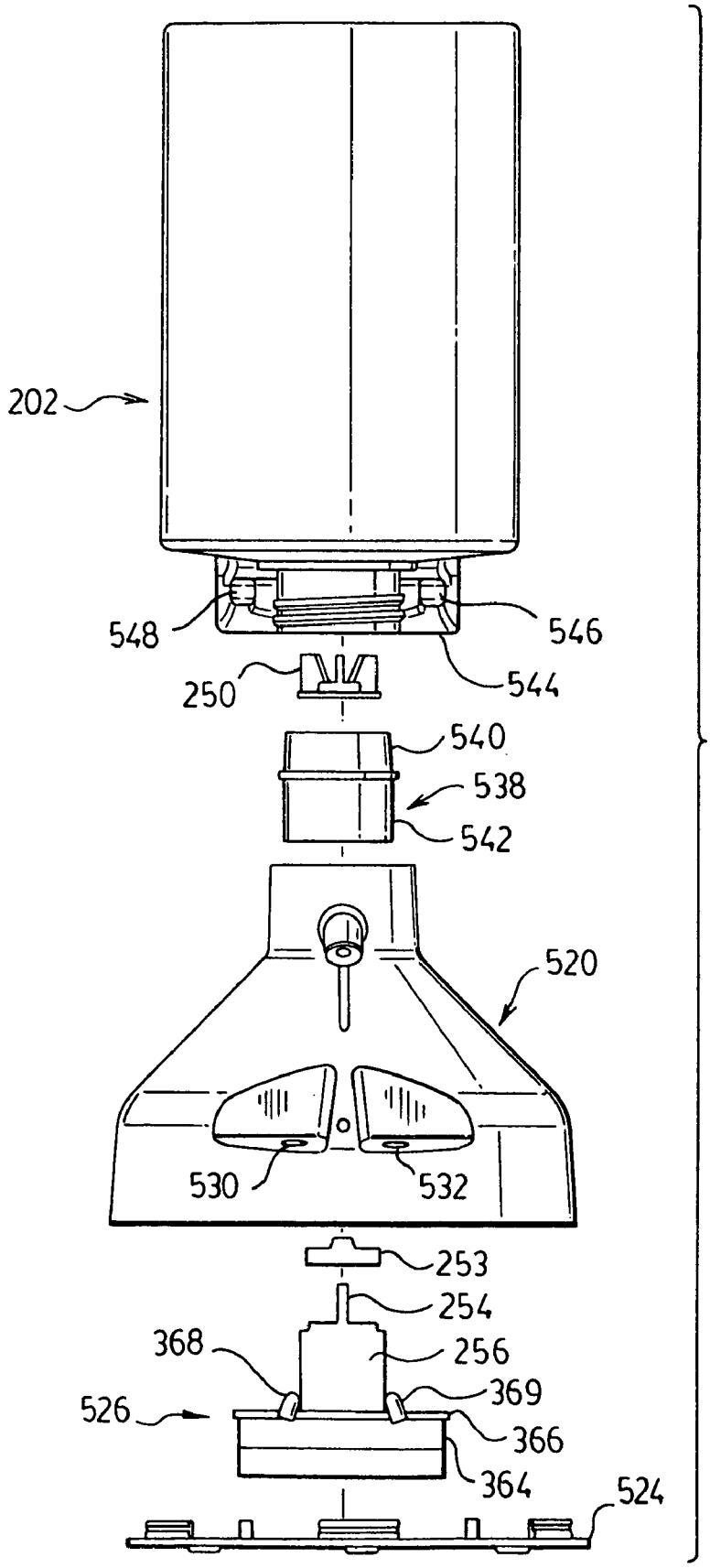
FIG. 47 is a schematic front view of the exploded components of the dispenser as shown in FIG. 46

So as to adapt for use with a bottle 202 which is a standard bottle with a conventional threaded neck 208, a separate adapter sleeve 538 is provided with a first tubular portion 540 received in a frictional fit inside the neck 208 of the bottle 202 and a second tubular portion 542 extending downwardly therefrom. FIG. 45 illustrates an assembled closed position condition similar to the in FIG. 26 with the adapter sleeve 538 in sealed relation with fructoconical position 229 of the side wall 36 of the base-cap 202.

As seen, an annular passageway 41 is defined radially outward of the second tubular portion 542 of the adapter sleeve 538 and the side wall 36 of the base-cap 202.

For use in dispensing to adopt a similar condition to that shown in FIG. 27, the bottle 202 in FIG. 45 is rotated relative the base-cap 202 to create an axial space between a lower end of the adapter sleeve 538 and the fructoconical portion 229 of the side wall.

The dispenser of FIGS. 43 to 47 may be portable and sit with the closure plate 524 resting on a support surface such as a table. FIGS. 43 to 47 however show the bottle 202 as removably secured to an optional wall mount bracket 544 with support arms 546 and 548 extending under the bottle 202 on either side of the threaded neck portion 208 of the bottle 202.

A preferred use of the dispenser of FIGS. 43 to 48 is for dispensing alcohol cleaning solutions. Such solutions are flammable and can have a relatively low flash point for example depending on the formulation, of 21° C. or lower. To reduce the risk of flame at the nozzle 522 or in the impeller chamber extending into the bottle 202, or to avoid risk of explosion in the bottle 202, flame barriers such as a wire mesh or screen may be disposed across the various passageways to resist flame on one side of the screen through progressing the screen. Preferably a mesh screen 550 only shown in FIG. 45 may extend across the inner end of the adapter sleeve 538 to sit on top of the sleeve 538 as shown in FIG. 45. A mesh screen may also be disposed across the nozzle or the passageway from the impeller chamber to the nozzle. Further explosion resistant materials such as a porous metal mesh may be provided to fill portions of the bottle 202.

Figure 48:
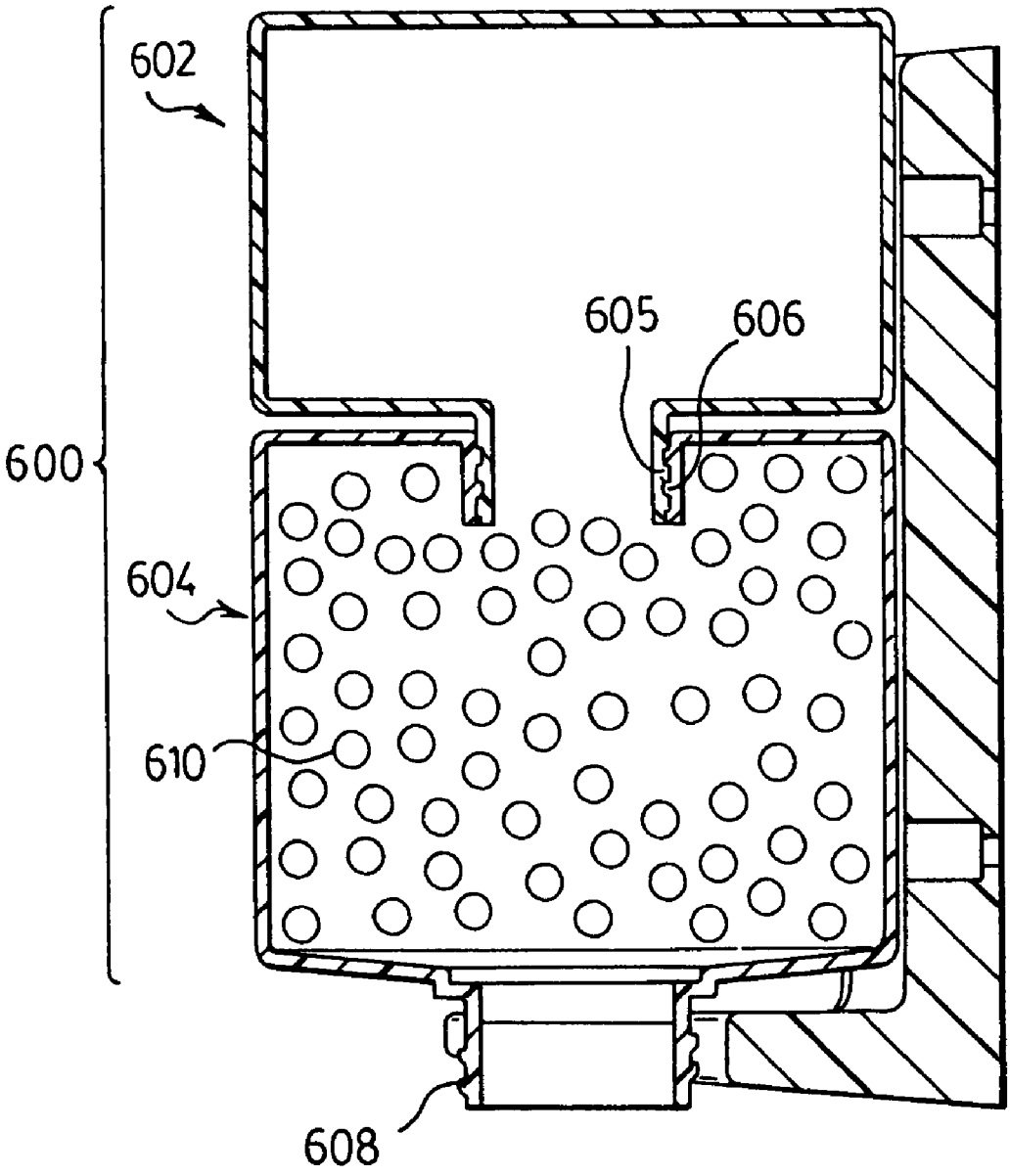
FIG. 48 is a cross-sectional side view of a flame resistant container to replace the container shown in FIG. 46.

Reference is made to FIG. 48 which illustrates a bottle assembly 600 for replacement of the bottle 202 in FIGS. 43 to 47. The bottle assembly comprises an upper bottle 602 and a lower vessel 604. The upper bottle 602 is a typical bottle with a male threaded neck 605 to receive merely an alcohol liquid to be dispensed. The lower vessel 604 has a threaded female inlet 606 to threadably receive the neck of 605 of the upper bottle 602. The lower vessel 604 has a male threaded neck 608 to engage the base-cap 204. The vessel 604 is filled with an explosion resistant matrix 610, only schematically shown, comprising a thin mesh of metal which has been collapsed and stuffed into the vessel 604 to substantially fill the same. The matrix 610 is porous and permits the alcohol to pass therethrough. As is known the matrix assists in preventing flames from passing into and through the vessel and in preventing explosion of flammable vapours and liquids in the vessel. The matrix 610 is preferably a filter mass insert to aid thermal distribution to suppress explosion and may be of the type taught in U.S. patents U.S. Pat. No. 3,356,256 to Szgo, U.S. Pat. No. 4,613,054 to Schrenk, U.S. Pat. No. 4,673,098 or U.S. Pat. No. 4,925,053 to Fenton, for example.

The dispenser illustrated in FIGS. 22 to 28, 31, 32 and 33 each provide a chamber within which an impeller is rotatable. The chamber has a base and side walls extending upwardly from the base and an exit opening at a height above the base. Fluid is in the chamber at a height below the exit opening. The impeller in the chamber is rotatable about an axis to discharge fluid impinging on the impeller so as to cause fluid in the chamber to be raised in the chamber to the height of the exit opening such that fluid above the exit opening exits the chamber via the exit opening. Rotation of the impeller preferably causes flow of fluid in the chamber to assume a standing wave which raises the height of the fluid in the container. One preferred standing wave is a vortex directing fluid radially outwardly into the side walls and up the side walls. The dispensers provide a reservoir to replenish fluid to the chamber, preferably vertically above the chamber providing a source of fluid for the chamber. The chamber and reservoir need not be interconnected. In the preferred embodiments a pressure relief mechanism restricts flow of fluid from a reservoir above the container and is operative to stop the fluid level in the chamber from becoming below a minimum or rising above a maximum other than when the impeller is operating. Other mechanisms than a pressure relief mechanism can be used to keep the fluid level in the chamber between a minimum and maximum such as a float valve mechanism which floats on the fluid level in the chamber or a chamber fluid indicator which may be operatively coupled to a valve to dispense fluid from the reservoir, as for example like solenoid valve 600 in FIG. 31.

While the invention has been described with reference to the preferred embodiments, many variations and modifications will now occur to a person skilled in the art. For a definition of the invention, reference is made to the appended claims.

I claim:

1. A liquid dispenser comprising:

a resilient, enclosed container enclosed but for having at one end of the container a neck open at a container outlet opening, a cap having an end wall and a side wall of extending upwardly from the end wall to a remote portion of the side wall, a cap outlet opening through the side wall, the cap received on the neck with the neck extending into the cap, the remote portion of the cap about the neck engaging the neck to form fluid impermeable seal therewith, a passageway defined between the neck and the side wall of the cap outwardly of the neck and inwardly of the side wall open to both the container outlet opening and the cap outlet opening, wherein when the container is in an inverted position with the neck located below the remainder of the container, the container outlet opening is at a height which is below a height of the cap outlet opening, the side wall of the cap being disposed about an axis, the container outlet opening disposed coaxially within the side wall of the cap, an impeller disposed in the cap above the end wall of the cap and at least partially below the container outlet opening journalled for rotation about the axis, the impeller adapted on rotation to receive fluid above the impeller from the container outlet opening and to direct liquid radially outwardly into the passageway such that rotation of the impeller forces fluid into the passageway raising the level of fluid in the passageway to a height above the height of the cap outlet opening such that fluid flows out of the cap outlet opening, the impeller when not rotating not preventing air flow from the cap outlet opening to the container outlet opening.

2. A liquid dispenser as claimed in claim 1 wherein the impeller when not rotating not preventing air flow or fluid flow between the container and cap.

3. A liquid dispenser as claimed in claim 1 wherein the impeller forms with the cap and container neck a centrifugal pump to direct fluid from the container outlet opening radially into the passageway.

4. A liquid dispenser as claimed in claim 3 wherein the cap is circular in cross-section about the axis, the neck of the container is circular in cross-section about the axis, and the passageway is annular about the axis.

5. A liquid dispenser as claimed in claim 1 wherein the impeller has a radial extent not substantially less than a radial extent of the container outlet opening.

6. A liquid dispenser as claimed in claim 1 wherein the impeller has a radial extent at least equal to a radial extent of the container outlet opening.

7. A liquid dispenser as claimed in claim 1 wherein the side wall of the cap has a lower cylindrical portion of a radius marginally greater than a radial extent of the impeller.

8. A liquid dispenser as claimed in claim 7 wherein the neck of the container has a lower cylindrical portion ending at the container outlet opening of a radius substantially the same as the radius of the lower cylindrical portion of the cap.

9. A liquid dispenser as claimed in claim 7 wherein the side wall of the cap opens upwardly from the lower cylindrical portion as a frustoconical portion.

10. A liquid dispenser as claimed in claim 1 wherein the container is resiliently deformable with an inherent shape having an inherent internal volume, the container being resilient such that after being deformed by forces forcing the container to assume shapes different than its inherent shape and having volumes less than the inherent volume, on release from such forces, the resiliency of the container biases the container toward reassuming its inherent shape and creating a vacuum in the container, when the container, in the inverted position, is deformed to the shapes different than the inherent shape, then liquid in the container is forced to flow out of the container via the container outlet opening through the passageway and out the cap outlet opening, when a vacuum exists in the container with the container in an inverted position, liquid in the cap is drawn back into the container until the height of liquid in the cap is below the height of the container outlet opening and the container outlet opening is open to air in the cap such that air in the cap flows under gravity upward through the neck into the container to decrease vacuum in the container, the container outlet opening at a height below a height of liquid in the container such that when pressure in the container is atmospheric pressure, due to gravity, the liquid from the container fills the neck and passageway to a height above the height of the container outlet opening and below the height of the cap outlet opening.

11. A liquid dispenser as claimed in claim 1 wherein the cap is movable relative the neck between a closed position in which the cap prevents fluid flow through the passageway and an open position in which the passageway is open to fluid flow.

12. A liquid dispenser as claimed in claim 11 wherein in the closed position, the end wall of the cap engages the neck to close the container outlet opening preventing fluid flow there through and, in the open position, the end wall is spaced away from the container outlet opening.

13. A liquid dispenser as claimed in claim 12 wherein the side wall of the cap is disposed coaxially about the neck and the cap is axially movable relative the neck between the open position and the closed position.

14. A liquid dispenser as claimed in claim 1 including a motor operatively coupled to the impeller, the motor located below the end wall of the cap, a rotatable shaft coaxial with the axis passing in a sealed relation through the end wall of the cap and coupled at a lower end to the motor and at an upper end to the impeller.

15. A liquid dispenser as claimed in claim 1 wherein the cap further includes a support portion extending downwardly to support surfaces to engage a planar work surface to support the dispenser in a vertical position for use in dispensing.

16. A liquid dispenser as claimed in claim 15 wherein the cap further includes a support portion extending downwardly to support surfaces to engage a planar work surface to support the dispenser in a vertical position for use in dispensing, and a chamber is defined below the base of the cap within the support portion, the motor received within the chamber.

17. A liquid dispenser as claimed in claim 15 wherein the motor is an electric motor, and batteries for powering the motor are received in the chamber.

18. A liquid dispenser as claimed in claim 1 including a motor operatively coupled to rotate the impeller when activated, and a switch mechanism to activate the motor, and wherein liquid may be dispensed by either rotation of the impeller on activation of the motor or by manually compressing the container.

19. A liquid dispenser as claimed in claim 18 including a mechanism for manual engagement to compress the container selected from one of a lever having a first portion which bears on a side surface of the container and a second portion available to be manually moved so as to urge the first portion to compress the side surface of the container and reduce the internal volume, and a resilient bulbous portion forming a portion of a side wall of the container for manual deformation to reduce the internal volume of the container.

20. A liquid dispenser as claimed in claim 1 including a motor magnetically coupled to the impeller to rotate the impeller.

21. A liquid dispenser comprising:

a resilient, enclosed container enclosed but for having at one end of the container a neck open at a container outlet opening, a cap having an end wall and a side wall extending upwardly from the end wall to a remote portion of the side wall, a cap outlet opening through the side wall, the cap received on the neck with the neck extending into the cap, the remote portion of the cap about the neck engaging the neck to form fluid impermeable seal therewith, a passageway defined between the neck and the side wall of the cap outwardly of the neck and inwardly of the side wall open to both the container outlet opening and the cap outlet opening, the side wall of the cap being disposed about an axis, the container outlet opening disposed coaxially within the side wall of the cap, an impeller disposed in the cap above the end wall of the cap and at least partially below the container outlet opening journalled for rotation about the axis, the impeller adapted on rotation to receive fluid above the impeller from the container outlet opening and to direct liquid radially outwardly into the passageway such that rotation of the impeller forces fluid into the passageway and out of the cap outlet opening.

22. A liquid dispenser as claimed in claim 21 wherein the cap is received on the neck for axial movement between an open position and a closed position, in the closed position, the neck about the container outlet opening engages the side wall of the cap to prevent communication from the container outlet opening and the passageway, in the open position, the neck about the container outlet opening is spaced from the side wall of the cap providing communication from the container outlet opening to the passageway.

* * * * *